US011043071B2

(12) United States Patent
Crittenden

(10) Patent No.: US 11,043,071 B2
(45) Date of Patent: Jun. 22, 2021

(54) CASINO MANAGEMENT NETWORKED COMPUTER SYSTEM AND METHODS OF OPERATING SAME

(71) Applicant: Konami Gaming, Inc., Las Vegas, NV (US)

(72) Inventor: Michael Crittenden, Henderson, NV (US)

(73) Assignee: Konami Gaming, Inc., Las Vegas, NV (US)

( * ) Notice: Subject to any disclaimer, the term of this patent is extended or adjusted under 35 U.S.C. 154(b) by 368 days.

(21) Appl. No.: 15/911,790

(22) Filed: Mar. 5, 2018

(65) Prior Publication Data

US 2018/0268652 A1 Sep. 20, 2018

Related U.S. Application Data

(60) Provisional application No. 62/473,769, filed on Mar. 20, 2017.

(51) Int. Cl.
*G07F 17/32* (2006.01)

(52) U.S. Cl.
CPC ..... *G07F 17/3255* (2013.01); *G07F 17/3223* (2013.01); *G07F 17/3225* (2013.01); *G07F 17/3239* (2013.01)

(58) Field of Classification Search
CPC ..... G07F 17/3255; G07F 17/3223; G07F 17/3225; G07F 17/3239
See application file for complete search history.

(56) References Cited

U.S. PATENT DOCUMENTS 5,102,134 A * 4/1992 Smyth ..... G07F 17/3244 273/143 R
5,263,716 A * 11/1993 Smyth ..... G07F 17/3244 273/143 R (Continued)

FOREIGN PATENT DOCUMENTS

JP 2003-022341 A 1/2003
WO 2012/176784 A1 12/2012

OTHER PUBLICATIONS

Office Action (CA Application No. 2,998,416; dated Jan. 11, 2019; 8 pages.

(Continued)

*Primary Examiner* — Omkar A Deodhar
*Assistant Examiner* — Matthew D Hoel
(74) *Attorney, Agent, or Firm* — Howard & Howard Attorneys PLLC

(57) ABSTRACT

A casino management networked computer system is described. The networked computer system includes a patron evaluation server computer including a processor programmed to initiate a tier review operation for patron account records having gaming transaction occurring within a predefined period of time. The processor programmed to determine a current tier level in a selected patron account record and determine a target tier level having a higher ranking. The processor is programmed to identify a tier point amount and an evaluation period associated with the target tier level, retrieve gaming transactions occurring within the identified evaluation period, calculate an amount of tier points based on the retrieved gaming transactions, and modify the selected patron account record to upgrade the tier level to the target tier level upon determining the calculated amount of tier points is equal to or greater than the tier point amount associated with the target tier level.

20 Claims, 19 Drawing Sheets

(56) References Cited

U.S. PATENT DOCUMENTS 5,511,784 A * 4/1996 Furry ..... G07F 17/3244 273/143 R
5,655,961 A 8/1997 Acres et al.
7,303,475 B2 12/2007 Britt et al.
7,410,422 B2 8/2008 Fine
8,200,348 B2 * 6/2012 Mazurik ..... G07F 17/32 700/91
8,696,433 B2 * 4/2014 Weller ..... G06Q 30/02 463/18
2003/0186744 A1 * 10/2003 Bradell ..... G07F 17/32 463/42
2003/0199303 A1 * 10/2003 Weiss ..... G07F 17/3244 463/17
2004/0077408 A1 * 4/2004 D'Amico ..... G07F 17/3239 463/42
2005/0227752 A1 * 10/2005 Weiss ..... G07F 17/3244 463/17
2006/0094495 A1 * 5/2006 Gelber ..... G07F 17/3244 463/20
2006/0241795 A1 * 10/2006 Weingardt ..... G07F 17/32 700/91
2010/0106266 A1 * 4/2010 Mazurik ..... G07F 17/32 700/91
2011/0086701 A1 * 4/2011 D'Amico ..... G07F 17/3267 463/29
2011/0172005 A1 * 7/2011 D'Amico ..... G07F 17/3255 463/25
2012/0009994 A1 * 1/2012 Cannon ..... G07F 17/32 463/29
2012/0034962 A1 * 2/2012 Amaitis ..... G07F 17/3293 463/13
2012/0088578 A1 * 4/2012 Cuddy ..... G07F 17/3258 463/27

OTHER PUBLICATIONS

Examination Report No. 2 (AU Patent Application No. 2018201788; dated Mar. 19, 2019; 4 pages.

* cited by examiner

90

128

Patron ID: 10001313
Address: 1234 Main Street, Anytown
Postal Code: 10234

140 144 142

| Session ID | Date | Start | End | Game Type | Total Wagered Amount |
|---|---|---|---|---|---|
| Session001 | 01/16/2016 | 20:32 | 22:05 | Slot | $232.00 |
| 92 Session002 | 01/16/2016 | 22:15 | 23:02 | Slot 146 | $105.00 |
| Session003 | 03/20/2016 | 20:05 | 21:32 | Table | $200.00 |
| Session004 | 05/14/2016 | 18:46 | 19:42 | Table 148 | $230.00 |
| 92 Session005 | 05/14/2016 | 20:22 | 21:45 | Slot | $250.00 |

FIG. 10

94

128 130 132 206

| Patron ID | Patron Name | Birthdate | Card ID | Tier Level Indicator | Total Wagers | Current Tier Points | Tier Points to Next Tier |
|---|---|---|---|---|---|---|---|
| 96 10001313 | John Smith | 12/16/1965 | 10001399 | Platinum | $20,034 | 99485 | 515 |
| 10001365 | Jane Doe | 01/12/1974 | 10002659 | Gold | $15,678 | 45259 | 4741 |
| 10002365 | Mary Doe | 07/29/1975 | 10009953 | Gold | $10,129 | 47695 | 2305 |

FIG. 11

98

130/134 136 138

| Card Tier Level | Bonus Points per $1 Coin-In | | Comp Reinvestment | |
|---|---|---|---|---|
| | Slots | Video Poker | Slot Reinv % | TG Reinv % |
| 100 Gold | 2 | 1 | 10.0 | 10.0 |
| 100 Platinum | 5 | 5 | 12.5 | 15.5 |
| Diamond | 10 | 10 | 15.0 | 20.0 |

FIG. 12

102

144

| Activity Type 146 | Base Point Accrual | | Tier Point Accrual | |
|---|---|---|---|---|
| | Measurement Data | Factor | Measurement Data | Multiplier |
| 104/198 Reel Machine | Total Coin In | 0.05 | Wager Amount | 0.05 |
| Sports Book | Wager Amount | 0.01 | Wager Amount | 0.05 |
| 104/202 Gaming Table | Avg. Bet per Hr. | 0.05 | Base Points | 1.0 |

200 204

148 194 196

FIG. 13

106 168

130/134 172 174 176 178 180 182

| Card Tier Type | Tier Point Amount | Tier Point Level Range | Theoretical Loss Value | Actual Loss Value | Evaluation Period | Expiration /Renewal Period |
|---|---|---|---|---|---|---|
| 170 Diamond | 50,000 | 50,000 – 100,000 | 5000 | 5000 | 181 days | 203 days |
| Platinum | 25,000 | 25,000 – 49,999 | 0 | 2500 | 181 days | 203 days |
| 170 Gold | 10,000 | 10,000 – 24,999 | 1500 | 1500 | 90 days | 120 days |

FIG. 14

108

| 128 Patron ID | 150 Date of Last Evaluation | 152 Expiration Date | 154 Freeze Level | 164 Lockout Expiration Date |
|---|---|---|---|---|
| 96 10001313 | 2/23/2016 | 8/01/2017 | No | N/A |
| 10001365 | 2/23/2016 | 8/01/2017 | No | N/A |
| 10002365 | 6/16/2016 | 12/30/2017 | Yes | 12/30/2018 |

FIG. 15

110

| 128 Patron ID | Date of Evaluation | 130 Current Tier | Previous Tier | Previous Tier Points |
|---|---|---|---|---|
| 10001313 | 2/23/2016 | Gold | Silver | 28,325 |
| 10001365 | 2/23/2016 | Gold | Gold | 45,253 |
| 10002365 | 6/16/2016 | Platinum | Gold | 56,823 |

FIG. 16

CASINO MANAGEMENT NETWORKED COMPUTER SYSTEM AND METHODS OF OPERATING SAME

CROSS-REFERENCE TO RELATED APPLICATION

This application claims benefit of U.S. Provisional Patent Application Ser. No. 62/473,769, filed on Mar. 20, 2017, which is hereby incorporated by reference in its entirety for all purposes.

FIELD OF THE INVENTION

The present invention relates generally to casino management systems, and more particularly, to a casino management system which tracks the gaming activities of patrons, stores data related thereto, and establishes a rating related to the relative worth of the patrons as a function thereof.

BACKGROUND OF THE INVENTION

The growth and competition in the casino gaming market in recent years and the increasingly sophisticated and complex technology being integrated into the gaming environment, presents both challenges and opportunities to gaming establishment operators. Over recent years, casino revenue has dramatically increased in the area of non-gaming revenue sources such as, hotel and hospitality, retail, dining, entertainment and other casino products or services. Traditionally, patron tracking systems have focused on tracking patrons of electronic gaming machines, table games and other gaming revenue areas such as, bingo and keno. In this traditional scenario, a patron is identified during gaming play by a patron tracking ID card and/or a patron identification number (PIN). The patron tracking system tracks the patron's gaming play and may award patron tracking points, bonuses, and other incentives according to established criteria to promote continued patron loyalty.

In most cases, the patron tracking points earned by play electronic gaming machines, table games and other gaming revenue areas such as, bingo and keno may be redeemed for prizes, such as complimentary meals, merchandise, hotel and services through non-gaming revenue point-of-sales devices linked to the patron tracking system. In these cases, non-gaming casino revenue patron tracking has been limited to the redemption of points and prizes earned by tracking the patron's play at gaming revenue sources. U.S. Pat. No. 5,655,961 teaches a method whereby patron tracking points are redeemed at a redemption counter in the casino for meals or clothing. The patron tracking points, therefore, are an additional inducement to encourage gaming revenue source play. U.S. Pat. No. 7,303,475 further extends this method whereby patrons can redeem their patron tracking points for non-gaming revenue products and services and can earn patron tracking point based on products or services purchases at remote redemption centers.

As non-gaming revenue increases, methods are needed to track and record the patron's purchases (spend). Furthermore, methods are needed to establish the profitability of patron's purchases and to rank and score the patron's net worth in the area of non-gaming revenue purchases. Moreover, there is an emerging category of casino patrons who are not members of the traditional casino patron club of electronic gaming machines, tables games or other gaming revenue sources, yet spend large amount of money in non-gaming revenue areas. Traditional patron tracking systems do not track, rate or score this category of patron.

Some casinos utilize an entirely separate system which may be used to store, independently, both player tracking data and other information related to the casino resort patron. The other information may be relate to the patron's transactions or visit, or originate at, the hotel, restaurant(s), retail outlet(s), spa(s), etc. . . . There are several problems with this approach. First, a completely different and additional system is used to receive the player tracking data (from the casino management system or CMS) and the other data and to store it. Secondly, such external systems must be tailored specifically to work with the CMS and other systems, such that the data from these systems is understood. In other words, the data from these systems is typically maintained in different formats and must be translated in order to be understood and stored. This is a very laborious and expensive undertaking. Furthermore, it is also difficult and expensive to maintain. For instance, if one of the underlying system changes, then the additional external system may also require corresponding updates.

The present invention is aimed at one or more of the problem as set forth above.

SUMMARY OF THE INVENTION

In different embodiments of the present invention, systems and methods for operating a casino management networked computer system including a player tracking system, are provided.

In one embodiment of the present invention, a casino management networked computer system is provided. The networked computer system includes a database server computer including a database server processor coupled to a database memory device, and a patron evaluation server computer including a processor. The database server processor programmed to generate and store a patron program file including a plurality of patron account records. Each patron account record includes a unique patron ID associated with a patron, a tier level indicator, and patron wagering data. The tier level indicator is associated with a tier level assigned to the patron account record. The tier level is selected from a ranked group of tier levels. Each of the ranked group of tier levels is associated with a plurality of award benefits provided by a casino property to the patron. The patron wagering data includes a plurality of gaming transaction records. Each gaming transaction record includes a transaction date and a wager amount of a corresponding gaming transaction. The database server processor is also programmed to generate and store a tier level program file including a plurality of tier level data records. Each tier level data record is associated with a tier level and includes a tier level indicator associated with a corresponding tier level, a tier point amount, an evaluation period including a number of days, and a renewal period including a number of days. The patron evaluation processor is programmed to initiate a tier review operation including accessing the plurality of patron account records and selecting patron account records having gaming transaction occurring within a predefined period of time. For each selected patron account record, the patron evaluation processor is programmed to determine a current tier level indicator included in the selected patron account record, access the tier level program file and determine a target tier level having a higher ranking than a tier level associated with the current tier level indicator, and identify a tier point amount and an evaluation period associated with the target tier level. The patron evaluation processor retrieves gaming transactions having transaction dates occurring within the identified evaluation period and calculates an amount of tier points based on the retrieved gaming transactions. The patron evaluation processor modifies the selected patron account record to upgrade the tier level assigned to the patron account record by replacing the current tier level indicator with a tier level indicator associated with the target tier level upon determining the calculated amount of tier points is equal to or greater than the tier point amount associated with the target tier level.

In another embodiment, a non-transitory computer-readable storage medium storing computer executable instructions is provided. The computer executable instructions cause a processor to perform a method including generating a patron program file including a plurality of patron account records. Each patron account record includes a unique patron ID associated with a patron, a tier level indicator, and patron wagering data. The tier level indicator is associated with a tier level assigned to the patron account record. The tier level is selected from a ranked group of tier levels. Each of the ranked group of tier levels is associated with a plurality of award benefits provided by a casino property to the patron. The patron wagering data includes a plurality of gaming transaction records. Each gaming transaction record includes a transaction date and a wager amount of a corresponding gaming transaction. The processor generates a tier level program file including a plurality of tier level data records. Each tier level data record is associated with a tier level and includes a tier level indicator associated with a corresponding tier level, a tier point amount, an evaluation period including a number of days, and a renewal period including a number of days. The processor initiates a tier review operation including accessing the plurality of patron account records and selecting patron account records having gaming transaction occurring within a predefined period of time. For each selected patron account record, the processor determines a current tier level indicator included in the selected patron account record, accesses the tier level program file, determines a target tier level having a higher ranking than a tier level associated with the current tier level indicator, and identifies a tier point amount and an evaluation period associated with the target tier level. The processor retrieves gaming transactions having transaction dates occurring within the identified evaluation period and calculates an amount of tier points based on the retrieved gaming transactions. The processor modifies the selected patron account record to upgrade the tier level assigned to the patron account record by replacing the current tier level indicator with a tier level indicator associated with the target tier level upon determining the calculated amount of tier points is equal to or greater than the tier point amount associated with the target tier level.

In yet another embodiment, a method of operating a networked computer system is provided. The method includes a database computer system generating a patron program file including a plurality of patron account records. Each patron account record includes a unique patron ID associated with a patron, a tier level indicator, and patron wagering data. The tier level indicator is associated with a tier level assigned to the patron account record. The tier level is selected from a ranked group of tier levels. Each of the ranked group of tier levels is associated with a plurality of award benefits provided by a casino property to the patron. The patron wagering data includes a plurality of gaming transaction records. Each gaming transaction record includes a transaction date and a wager amount of a corresponding gaming transaction. The database computer system generates a tier level program file including a plurality of tier level data records. Each tier level data record is associated with a tier level and includes a tier level indicator associated with a corresponding tier level, a tier point amount, an evaluation period including a number of days, and a renewal period including a number of days. A patron evaluation computer system initiates a tier review operation including accessing the plurality of patron account records and selecting patron account records having gaming transaction occurring within a predefined period of time. For each selected patron account record, the patron evaluation computer system determines a current tier level indicator included in the selected patron account record, accesses the tier level program file, determines a target tier level having a higher ranking than a tier level associated with the current tier level indicator, and identifies a tier point amount and an evaluation period associated with the target tier level. The patron evaluation computer system retrieves gaming transactions having transaction dates occurring within the identified evaluation period and calculates an amount of tier points based on the retrieved gaming transactions. The patron evaluation computer system modifies the selected patron account record to upgrade the tier level assigned to the patron account record by replacing the current tier level indicator with a tier level indicator associated with the target tier level upon determining the calculated amount of tier points is equal to or greater than the tier point amount associated with the target tier level.

BRIEF DESCRIPTION OF THE DRAWINGS

Other advantages of the present invention will be readily appreciated as the same becomes better understood by reference to the following detailed description when considered in connection with the accompanying drawings wherein:

FIGS. 10-16 are illustrations of exemplary data files generated by the system shown in FIGS. 1-3, 5, and 6, according to embodiments of the present invention.

Corresponding reference characters indicate corresponding parts throughout the drawings.

DETAILED DESCRIPTION OF INVENTION

Figure 1:
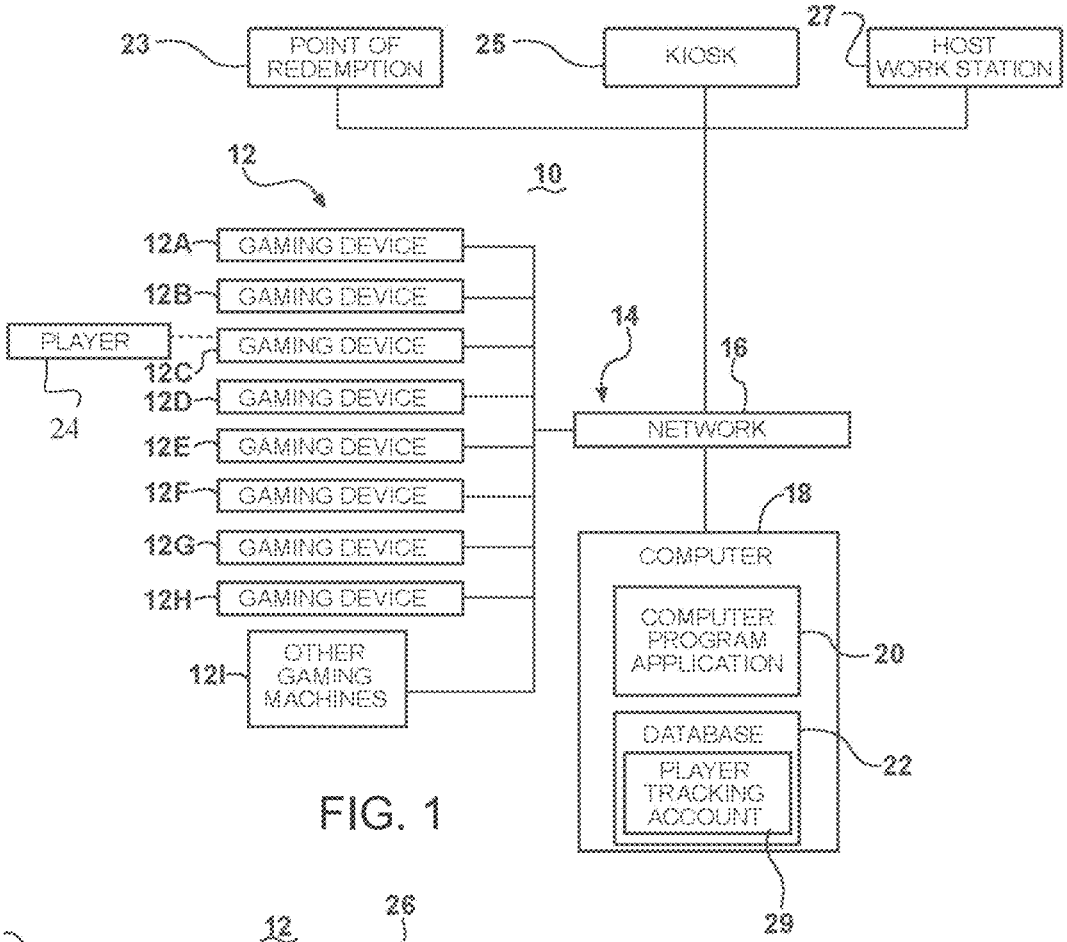
FIG. 1 is schematic diagram of a networked computer system for tracking gaming and non-gaming activities of a patron at a resort, according to an embodiment of the present invention.

With reference to the drawings, and in operation, the present invention improves the function of known computer operating systems by providing a system configured to automatically adjust a card level ranking associated with a patron by calculating a plurality of tier evaluation values associated with wagering activity of a patron including, but not limited to, a tier point balance, a theoretical loss value, and/or an actual loss value associated with wagering activities of the patron during an evaluation period. The system is configured to monitor patron wagering activity at a casino and provide bonus awards to the patrons based on the wagering activity and the current patron tier (e.g., player card level). In the illustrated embodiment, the system includes a SYNKROS™ Card Level Automation (CLA) computer program that is configured for all patron card level award tiers to have the same initial static evaluation period. The system also enables users to manually managed and adjust the tier evaluation periods include in the Card Level Automation process. The SYNKROS™ system of the present invention also generates and displays a progress bar at the EGM on the True-Time Display™ or the True-Time Windowing™ informing the customer on how many "Tier Points" are needed to reach the next level and displays the evaluation period. Patrons Tier Points are cumulative and carried forward as they progress to the next tier.

The system is also configured to implement a card level automation (CLA) computer program that includes a patron evaluation performed for different periods by patron card level tiers. The system monitors patron wagering activity to calculate tier points earned to qualify for bonus point awards based on card level tiers. The system may be programmed to reset tier points earned to qualify for a current tier once a patron is assigned to the next tier. The CLA program may also include a Rolling Qualifications evaluation dated or Fixed evaluation date for use in calculating a patron tier evaluation value.

In one embodiment, the system is programmed to adjust card level associated with patron account records at regular intervals. The system may use different intervals per card tier. In addition, the system is programmed to allow evaluation intervals to be configurable to either "Rolling qualifications" or Fixed Date. The start date of the evaluation period rules, and the system may nightly evaluate all players that played the current day, and then evaluate them on six month periods.

The system implements a nightly review of patron account records associated with patrons who had wagering and/or purchasing activity in prior 24-hour period (since last nightly review). For example, in one embodiment, the system may schedule patron account reviews right after midnight. The system uses last 182 days to qualify a patron for a level based on nightly review with Uptiers (Ups): calculated if active in prior 24 hour period; Renewals (Ats): calculated if expiration occurred prior day; and Downtiers (Dns): calculated if expiration occurred prior day.

The system may use +203 days to apply next expiration date that varies based on tier movement type (21 days added to 182 days to allow for time to notify guest), with Uptiers (Ups): 203 days after uptier date (established by nightly review); Renewals (Ats): 203 days after expiration date (expirations reviewed nightly); and Downtiers (Dns): 203 days after expiration date (unless Classic/lowest level) (expirations reviewed nightly).

The system may calculate sum of tier tally points on slots and tables to qualify based on qualification period. The system may also calculate alternate criteria values such as total theoretical loss or total actual loss, to qualify based on qualification period. For downtiers, the system provides an option to turn on or off capability to downtier by one level only.

The system also provides an ability to manually uptier, renew or downtier guests including Uptiers (Ups): calculates and populates new expiration date field based on 203 days after present date, and provides a user with the ability to alter expiration date; Renewals (Ats) or Downtiers (Dns): calculates and populates new expiration date field based on 203 days after current/old expiration date, and provides a user with the ability to alter expiration date.

The system also includes the ability to manually alter expiration dates, by default new expiration date is 203 days after upcoming expiration date, but can be altered by user. (Expiration Adjustment: EXADJ.).

The system also provides a user the ability to categorize a player's card level as frozen and identify it as frozen in reports. Used in the past for expelled guests so that they wouldn't be automatically uptiered if expulsion ended. Also, used for VIP players to never have Diamond tier level altered. (Tier Freeze: TRFRZ.).

The system also includes the ability for users through the Synkros interface to see total tier point tally, total theo levels, and total actual levels (alt criteria) for uptier qualification for varying time periods (i.e., based on last 152 days, last 175 days, 181 days, or other; configurable by user).

The system also includes the ability for users through the Synkros interface to see total tier point tally, total theo levels, and total actual levels (alt criteria) for renewal qualification. Based on 182 days before expiration date through present.

The system also provides available data pulls for Database Marketing to be able to create through views in DAL, campaign management tool, Konami Enterprise Intelligence, or other Konami interface including:

1. Pull list of all Platinum and Diamond expirations occurring in the next evaluation period. (2 to 4.5 weeks out, next 1-15th or 16th-EOM (end of month) date range). Automatically sent to casino operator, DM, Host Admin and Executive Hosts on the first and 16th of every month. These lists will be used by casino marketing to determine who should be given a renewal exception due to borderline play or other factors. Casino admin will adjust expiration date before expiration occurs so that downtier does not take effect on upcoming expiration date.

2. Ability to pull list of all uptiers. On a nightly basis, or using a user defined date range, Diamond and Platinum uptiers list (mailable and unmailable) sent to casino operator for card printing, DM and Host Admin for uptier kit assembly. Platinum and Diamond data lists formatted for Microsoft Word mail merge file, letters and envelopes. Also, need ability to create Gold uptiers list for DM team to send to mailhouse twice a month, every 1st and 16th for prior uptier period.

3. Pull mailing list for all renewals and downtiers on 1st and 16th for prior evaluation period. Automatically created for DM team to send to mailhouse.

4. Uptier audit report to catch outliers/inflated ratings. Top decile of prior days, or prior week's, uptiered guests with highest tier tally points to review for inflated ratings. DM may also eventually want to create a report that compares historic ADT (or ADA) against the prior day Theo or Actual where a guest has an uptier. Where we see a significant variance %, conduct a manual review by casino marketing management/supervisor staff. Show old club level, new uptiered club level, historic ADT/ADA prior to yesterday, yesterday's theo and actual, ADT variance %, ADA variance %, sums of tier point tally, Slot Coin In, Table Bets, Slot Theo, Table Theo, Slot Actual, Table Actual, Slots Time On Device, and Tables minutes played in qualification period. Automatically send to tier audit email group.

5. Diamond to Platinum downtier report.

A selected embodiment of the invention will now be explained with reference to the drawings. It will be apparent to those skilled in the art from this disclosure that the following description of the embodiment of the invention is provided for illustration only and not for the purpose of limiting the invention as defined by the appended claims and their equivalents.

Referring to FIGS. 1-3, 5 and 6, in the illustrated embodiment, the system 10 includes a plurality of devices 12 that are coupled to an entertaining management and monitoring system 14 with a communications network 16. The entertaining management and monitoring system 14 includes a server computer system 18 that is coupled to the plurality of devices 12 for use in tracking patron events at each of the devices 12. In one aspect of the present invention, the devices 12 may be gaming machines 12A-12H, 12I or non-gaming machines 12J, 12K, 12L, such as, for example, point-of-sale (POS) terminals, gaming tables, and/or sports book terminals.

For example, in one embodiment, a non-gaming machine 12J, 12K,12L, may include a user computing device 12 that is configured to transmit and receive data to and/or from the server computer system 18 to display graphical interfaces to enable a user to interact with an operate the system 10 with the user computing device 12. In the illustrated embodiment, the server computer system 18 is coupled to each user computing device via the communications network 16 that enables each user computing device to access the server computer system 18 over the network 16 such as, for example, the Internet, a cellular telecommunications network, a wireless network and/or any suitable telecommunication network. For example, in one embodiment, the user computing device 12 may include a mobile computing device, e.g., a smartphone that communicates with the server computer system 18 via the cellular telecommunications network and/or the Internet. In another embodiment, the user computing device 12 may include a personal computer, laptop, cell phone, tablet computer, smartphone/tablet computer hybrid, personal data assistant, and/or any suitable computing device that enables a user to connect to the server computer system 18.

In one aspect of the present invention, the system 10 receives information related to the player(s)' and/or patron(s)' use of the devices 12 and establish a player rating based thereon. The player rating may be a single number which reflects a value reflective of the player or patron's relative "worth" to a casino or resort. In one aspect of the present invention, the patron's relative worth may be first established with respect to a plurality of predetermined criteria. For example, in one embodiment, the predetermined criteria include recency, i.e., how recent has the player or patron used a device 12 or visited the casino or resort, frequency (of visits), monetary value, and profit margin (see below).

In one embodiment, the server computer system 18 is configured to generate data regarding the patrons' use of the devices 12 (gaming and non-gaming) and, for a given time period, each patron is scored relative to all other patrons for each criteria. The scores, for example, may be established as percentiles. For example, assuming that there are 100 patrons, if one of the patrons frequented the resort more than all other patrons during the past month, that patron would be in the $99^{th}$ percentile.

For each patron, their percentile score is established for each criterion. The percentile scores are then combined to establish a single value using a predetermined weighting scheme. For example, the single value may be established using:

$$(A*R)+(B*F)+(C*M)+(D*P),$$

where A, B, C, & D are first, second, third and fourth weighting factors and R, F, M & P are the patron's percentile scores for recency, frequency, monetary value, and profit margin.

Generally, the weighting factors are set by the casino and may be changed. Sample weighting factors are 15%, 15%, 30%, and 40%, respectively.

The single value may be established for different time periods. For example, in one embodiment, the single value may be established for the last month, the last three months, the last 12 months, and lifetime. The single values may be combined, for example, by averaging, to establish a total value.

Any of the single values or the total value may be utilized by the casino for a myriad of purposes (see below).

In one embodiment, the system 10 and method may be embodied or implemented via an entertaining management and monitoring system 14 which is shown in block diagram form in FIG. 1. The entertainment and monitoring system 14 may include additional functions such as, real-time multi-site, slot accounting, player tracking, cage credit and vault, sports book data collection, Point of Sale (POS) accounting, keno accounting, bingo accounting, and table game accounting, a wide area progressive jackpot, and electronic funds transfer (EFT).

As shown, the system 10 includes a plurality of devices 12. Devices 12 may include, but are not limited to gaming machines, electronic gaming machines (such as video slot, video poker machines, or video arcade games), electric gaming machines, virtual gaming machines, e.g., for online gaming, an interface to a table management host workstation 27 for table games, kiosks 25, point of sale or redemption terminals 23, or other suitable devices at which a patron may interact or access a user or player account. In the illustrated embodiment, eight electronic gaming devices or machines (EGM) 12A-12H are shown. However, it should be noted that the present invention is not limited to any number or type of machines 12. In one embodiment, the machines 12 are organized into banks (not shown), each bank containing a plurality of machines 12.

Other types of gaming machines which may be included (see above) are indicated with reference number 12I. The devices 12 are connected via a network 16 to one or more host computers or servers 18, which are generally located at a remote or central location. The server computer system 18 includes a computer program application 20 which maintains one or more databases 22. In one embodiment, the database(s) are Oracle database(s).

The computer program application 20 and databases 22 may be used to record, track, and report accounting information regarding the gaming machines 12 and players of the gaming machines 12. Additionally, the computer program application 20 and database(s) 22 may be used to maintain information related to player or player tracking accounts (see below).

In general, the machines 12 may be used by a user or player, i.e., to access their player account. For example, a gaming machine 12C is playable by a player 24. The player 24 may select one of the gaming machines 12C to play and insert a coin, credit, coupon, and/or player tracking card (not shown) into the chosen EGM 12C. Generally, the gaming machines 12C have an associated number of credits or coins required in order to play. In the case of video slot or poker games, the game is played and an award in the form of credits may be awarded based on a pay table of the gaming machine 12.

Figure 2:
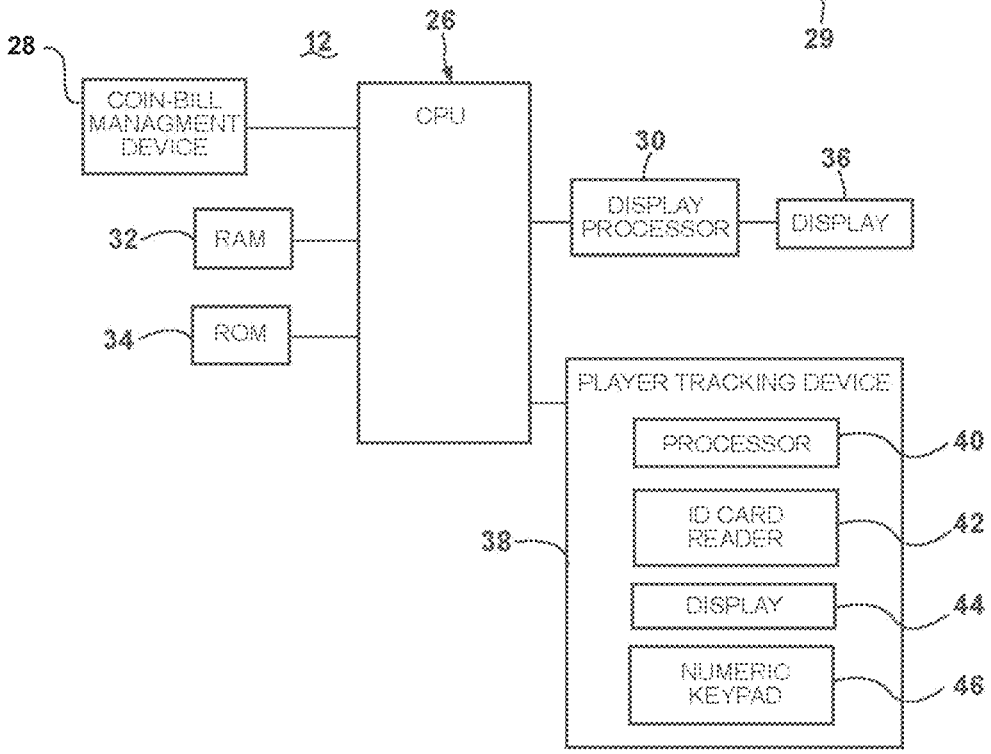
FIG. 2 is a schematic diagram of a gaming machine for use with the system of FIG. 1.
Figure 3:
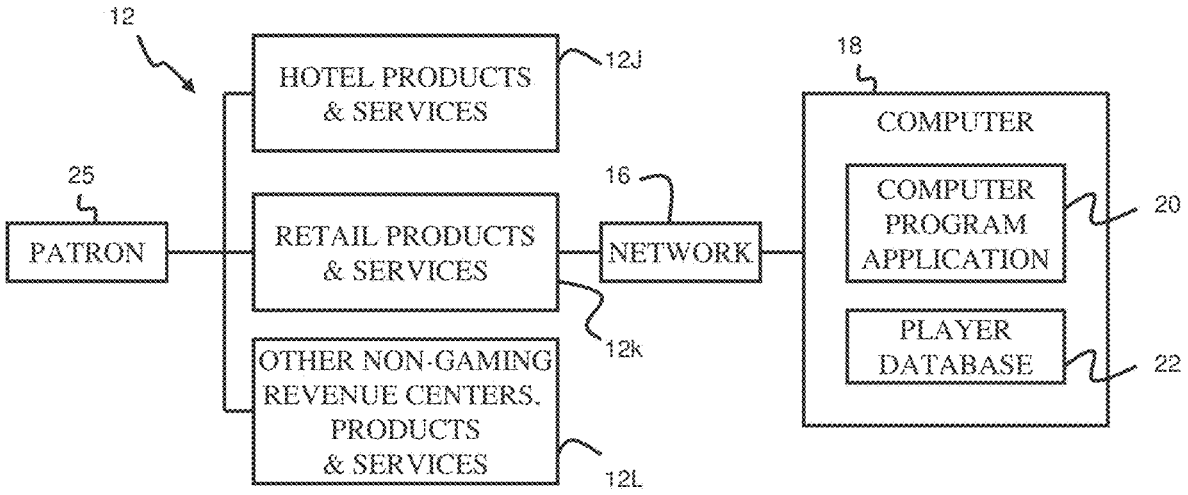
FIG. 3 is another schematic diagram of the system of FIG. 1, according to an embodiment of the present invention.
Figure 7:
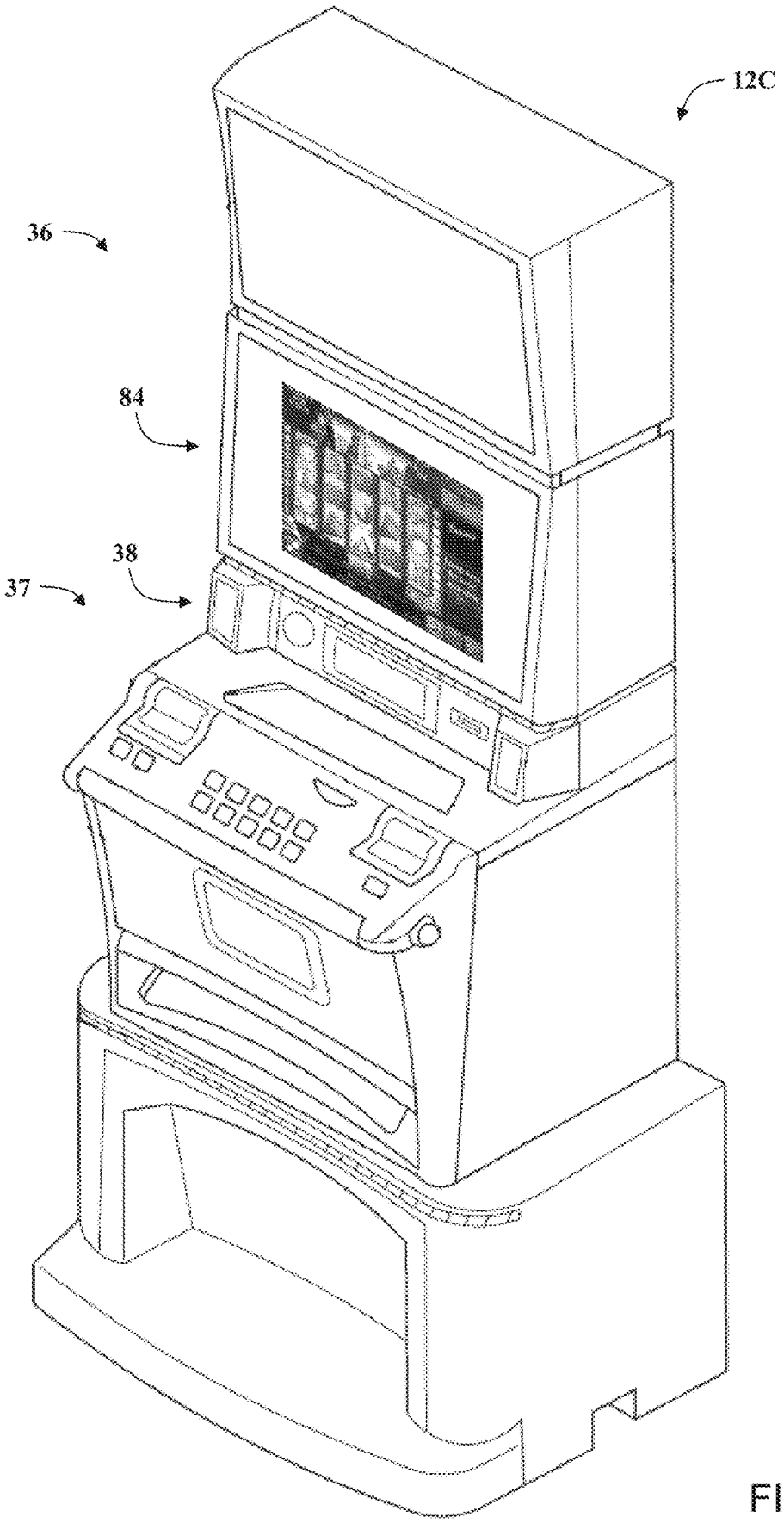
FIG. 7 is a schematic of a gaming machine that may be used with the system shown in FIGS. 1-3, 5, and 6, according to an embodiment of the present invention.

FIG. 2 is a block diagram of a suitable electronic gaming machine 12C. FIG. 7 is a schematic view of the gaming machine 12C. In one embodiment, the gaming machine 12C may be a video gaming machine preferably installed in a casino The machine 12C comprises a game controller 26, or central processing unit (CPU), a coin-bill management device 28, a display processor 30, a RAM 32 as a memory device and a ROM 34 (generally provided as an EPROM). The CPU 26 is mainly composed of a microprocessor unit and performs various calculations and motion control necessary for the progress of the game. The coin-bill management device 28 detects the insertion of a coin or a bill and performs a necessary process for managing the coin and the bill. The display processor 30 interprets commands issued from the CPU 26 and displays desirable images on a display 36. The RAM 32 temporarily stores programs and data necessary for the progress of the game, and the ROM 34 stores, in advance, programs and data for controlling basic operation of the machine 12C, such as the booting operation thereof, game code and graphics.

With reference to FIG. 7, in one embodiment, the gaming machine 12C may be a video gaming machine preferably installed in a casino. In the illustrated embodiment, the gaming machine 12C includes a gaming display 36 for displaying a plurality of games, a user input device 37 to enable a player to interface with the gaming machine 12C, and a gaming controller 26 that is operatively coupled to the gaming display 36 and the user input device 37 to enable a player to play games displayed on the gaming display 36. The gaming machine 12C also includes a cabinet assembly that is configured to support the gaming display 36, the user input device 37, and/or the gaming controller 26 from a gaming stand and/or a supporting surface.

The gaming display 36 and the user input device 37 are coupled to the cabinet assembly and are accessible by the player. In one embodiment, the gaming controller 26 is positioned within the cabinet assembly. Alternatively, the gaming controller 26 may be separated from the cabinet assembly, and connected to components of the gaming machine through a network such as, for example, a local area network (LAN), a wide area network (WAN), dial-in-connections, cable modems, wireless modems, and/or special high-speed Integrated Services Digital Network (ISDN) lines.

In one embodiment, the user input device 37 includes a plurality of input buttons, a coin slot, and/or a bill acceptor. The coin slot includes an opening that is configured to receive coins and/or tokens deposited by the player into the gaming machine. The gaming controller 26 converts a value of the coins and/or tokens to a corresponding amount of gaming credits to establish a credit balance that are used by the player to wager on games played on the gaming machine.

The bill acceptor includes an input and output device that is configured to accept a bill, a ticket, and/or a cash card into the bill acceptor to enable an amount of gaming credits associated with a monetary value of the bills, ticket, and/or cash card to be credited to the gaming machine. Moreover, the gaming machine may also utilize a cashless wagering system (not shown), such as a ticket in ticket out (TITO) system (not shown). In one embodiment, the bill acceptor also includes a printer (not shown) that is configured to dispense a printed voucher ticket that includes information indicative of an amount of credits and/or money paid out to the player by the gaming machine during a gaming session. The voucher ticket may be used at other gaming machines, or redeemed for cash, and/or other items as part of a casino cashless system (not shown).

A coin tray is coupled to the cabinet assembly and is configured to receive a plurality of coins that are dispensed from the gaming machine. One or more speakers are installed inside the cabinet assembly to generate voice announcements and/or sound effects associated with game play. The gaming machine also includes one or more lighting devices that are configured to blink and/or change brightness and color in specific patterns to produce lighting effects to enhance a visual gaming experience for the player.

In one embodiment, the input buttons include a plurality of BET switches for inputting a wager on a game, a plurality of selection switches for selecting a betting line and/or card, a MAXBET switch for inputting a maximum wager, a PAYOUT switch for ending a gaming session and dispensing accumulated gaming credits to the player, and a start switch, i.e., a SPIN/DEAL button to initiate an output of a game.

In the illustrated embodiment, the BET switches include five switches from 1BET to 5BET to enable a player to wager between a minimum bet up to 5× minimum bet. Each selection switch corresponds to a betting line such as, for example, a payline and/or symbol for a reel game, one or more cards for a card game, and/or a symbol for a roulette game, to enable a player to associate a wager with one or more betting lines. The MAXBET switch enables a player to input the maximum bet that a player can spend against one play of a game. The PAYOUT switch enables a player to receive the amount of money and/or credits awarded to the player during a gaming session, which has been credited onto the gaming machine. Input to the gaming device 12C may be accomplished via mechanical switches or buttons or via a touchscreen interface (not shown). Such gaming machines 12 are well known in the art and are therefore not further discussed.

Figure 23:
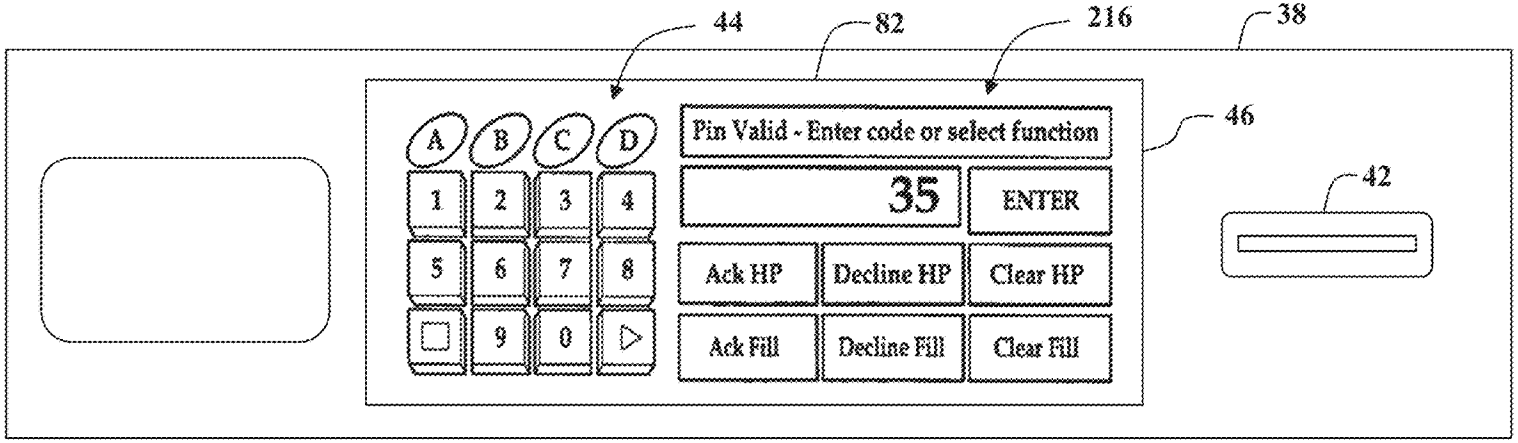
Figure 24:
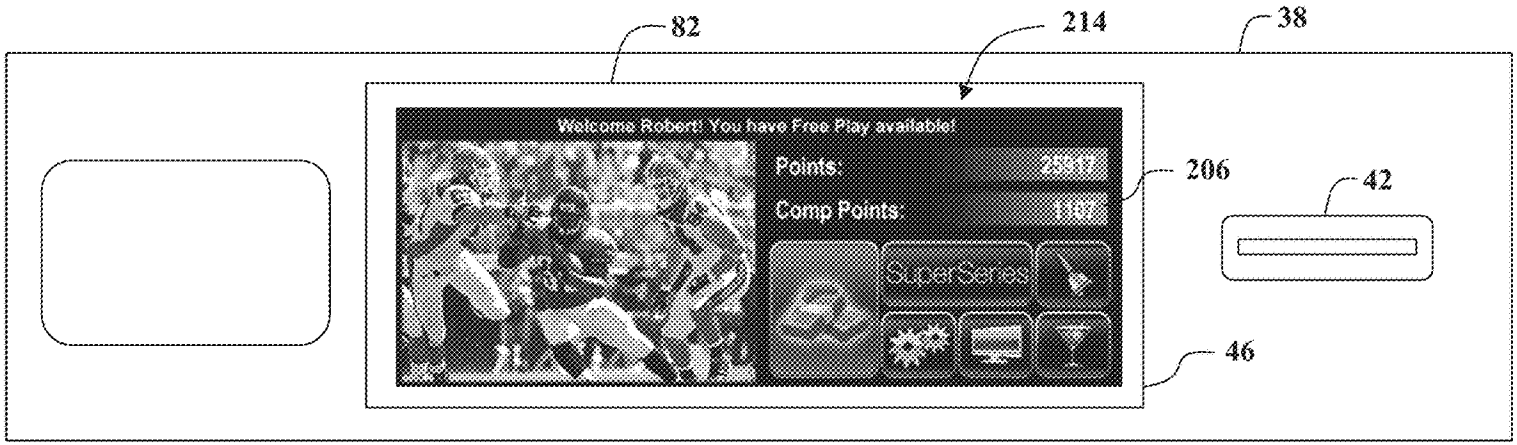
Figure 25:
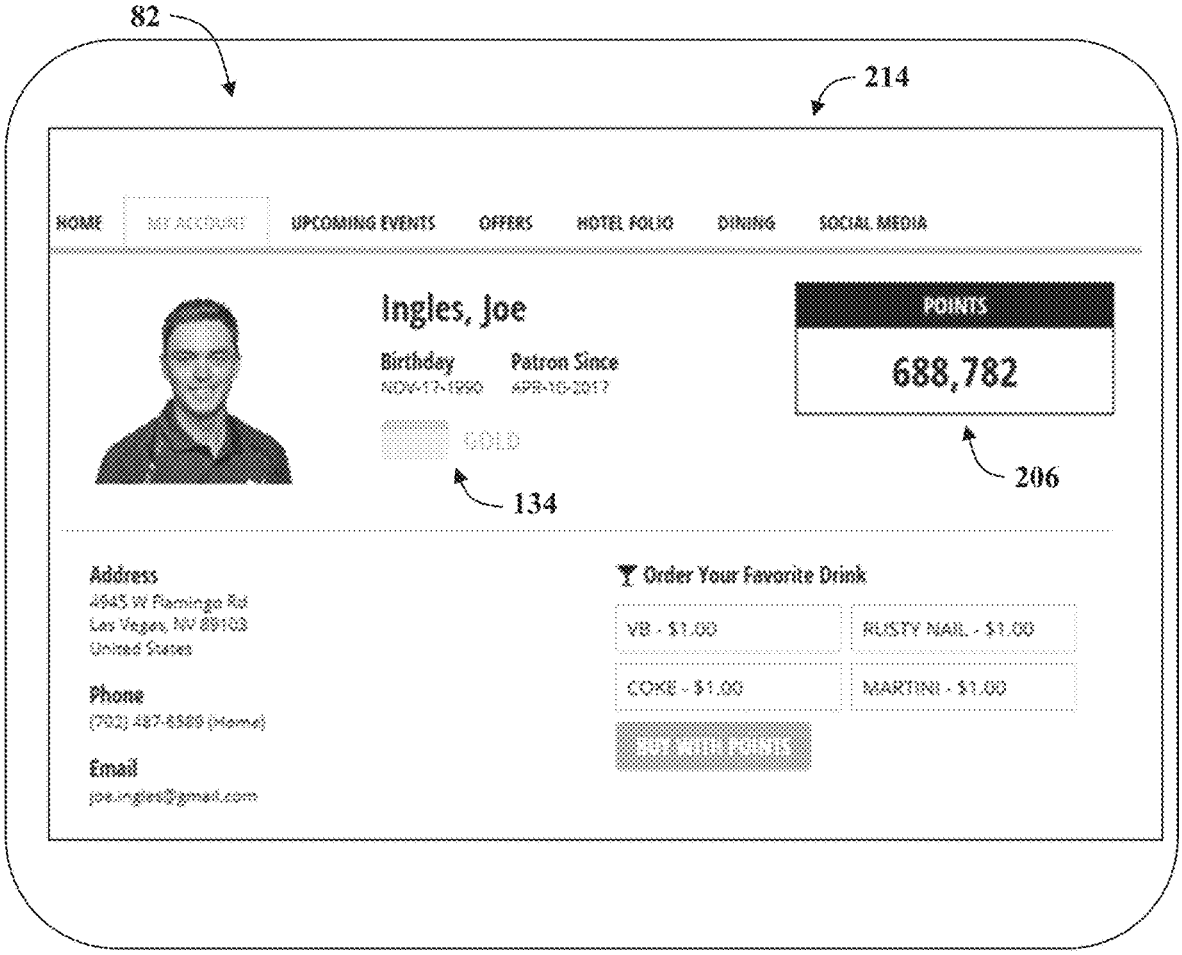
Figure 26:
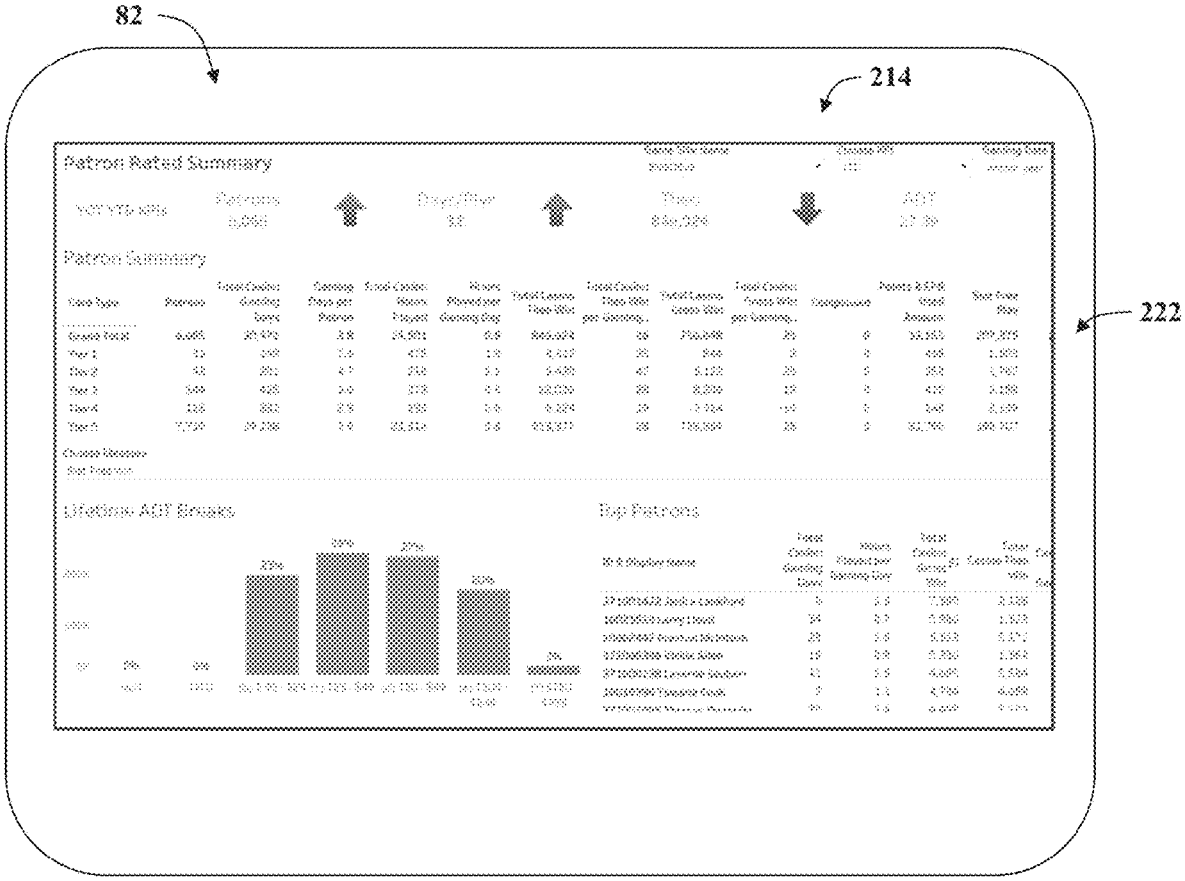

The player 24 and/or patron 24 is identified via the player tracking card and/or a player identification number entered into player tracking device 38 at each EGM 12 (shown in FIGS. 7 and 23-24). Player tracking accounts may be used, generally, to provide bonuses to a player, in addition to the award designated by, in the case of a video slot or poker machine, the EGM's 12 paytable. These bonuses may be awarded to the player 24 based a set of criteria, including, but not limited to, a) the player's play on the machine 12C, b) the player's overall play, c) play during a predetermined period of time, and d) the player's birthday or anniversary, or e) any other definable criteria. Additionally, bonuses may be awarded on a random basis, i.e., to a randomly chosen player or randomly chosen game 12. Bonuses may also be awarded in a discretionary manner or based on other criteria, such as, purchases made at a gift shop or other affiliated location.

In one embodiment, the player tracking device 38 includes a processor 40, a player identification card reader 42 and/or a numeric keypad 44, and a display 46. In one embodiment, the display 46 is a touchscreen panel and the numeric keypad 44 is implemented thereon.

The player 24 may be identified by entry of a player tracking card into the player identification card reader 42 and/or entry of a player identification number (PIN) on the numeric key pad 46. The play tracking device 38 may also be used to communicate information between the server computer system 18 and the corresponding EGM 12C. The player tracking device 40 may also be used to track bonus points, i.e., incentive points or credits, downloaded from the server computer system 18.

Each device 12 has a value associated therewith. With respect to the gaming machines 12A-12I, the value is a theoretical hold percentage. The theoretical hold percentage may be defined as the casino or establishment's estimated, average revenue percentage. For example, if the gaming machine 12 is a slot machine, the hold percentage is the expect house's estimate, average take or revenue for a particular machine. For a non-gaming device 12, e.g., a point of sale terminal, such as a cash register, a restaurant, or a spa, the theoretical hold percentage may be set to an estimated profit percentage for the given device 12.

In one aspect of the present invention, each player tracking device 38 is associated with one of the electronic gaming machines 12A-12I. The player tracking devices 38 identify patrons interacting with the system 12, for track wagers made by the players on the electronic gaming machines 12A-12I and record wager data associated with each wager made by the player and a respective electronic gaming machine 12A-12I. In one embodiment, the wager data includes a device type associated with respective gaming machine, an electronic gaming machine identifier, the theoretical hold percentage associated with the respective gaming machine, and an amount of the respective wager. The wager data may also include a player ID and a date/time stamp.

The server computer system 18 is in communication with the player tracking devices 38 and the non-gaming machines 12J, 12K, 12L for receiving the wager data associated with the patrons and the respective gaming machine 12A-12I from the player tracking device 38 and storing the wager data in a database and, for receiving transaction data associated with a transaction associated with the patrons' use of the non-gaming devices 12J, 12K, 12L and storing the transaction data in the database. The computer also establishes a player rating associated with each player as a function of the wager data and the transaction data.

In one embodiment of the present invention, the transaction data includes a device type of the non-gaming machine 12J, 12K, 12L, an identifier of the non-gaming machine, and the estimated profit of the non-gaming machine. The transaction data may also include a patron ID and a date/time stamp.

In one embodiment, the wager data and the transaction data are stored in a table in the database. In another embodiment, the wager data is stored in a first table in the database and the transaction data is stored in a second table in the database.

In one embodiment, the server computer system 18, in establishing the player rating, performs the following steps:

(a) establishes a first percentile ranking for each patron relative to the other patrons as a function of the wager and transaction data for a first predetermined time period in each of a plurality of criteria, (b) establishes a first valuation number as a function of the percentile rankings in each of the plurality of criteria and a plurality of predetermined weighting factors, (c) establishes a second percentile ranking for each patron relative to the other patrons as a function of the wager and transaction data for a second predetermined time period in each of the plurality of criteria, and (d) establishes a second valuation number as a function of the percentile rankings in each of the plurality of criteria and the plurality of predetermined weighting factors.

As discussed above, the server computer system 18 may combines the first and second valuation numbers into an overall valuation number. Furthermore, the system 10 may establish additional valuation numbers for different time periods, for example, the previous month, the previous three months, the previous year, and lifetime, i.e., all available data.

In one embodiment, the criteria includes recency, frequency, monetary value, and profit margin. Recency refers to the most recent or last visit to the resort by the player as determined by the last use of one of the devices 12. Frequency refers to the number of visits or uses by the player or patron's use of the devices. The monetary value is the amount spent and wagered by the player/patron during the time period. The profit margin is a value determined by multiplying the amount wagered or spent multiplied by the theoretical win or the estimate profit percentage of the gaming machine 12A-12I or non-gaming machine 12J, 12K, 12L. This determined for each wager and transaction and then added together.

In one embodiment, the wager data and the transaction data are stored in a single table in the database or in separate tables. However in one embodiment, even if the data is stored in two different tables, the fields of the table are the same. It should be noted that each wager and each transaction is stored as a separate record.

Figure 5:
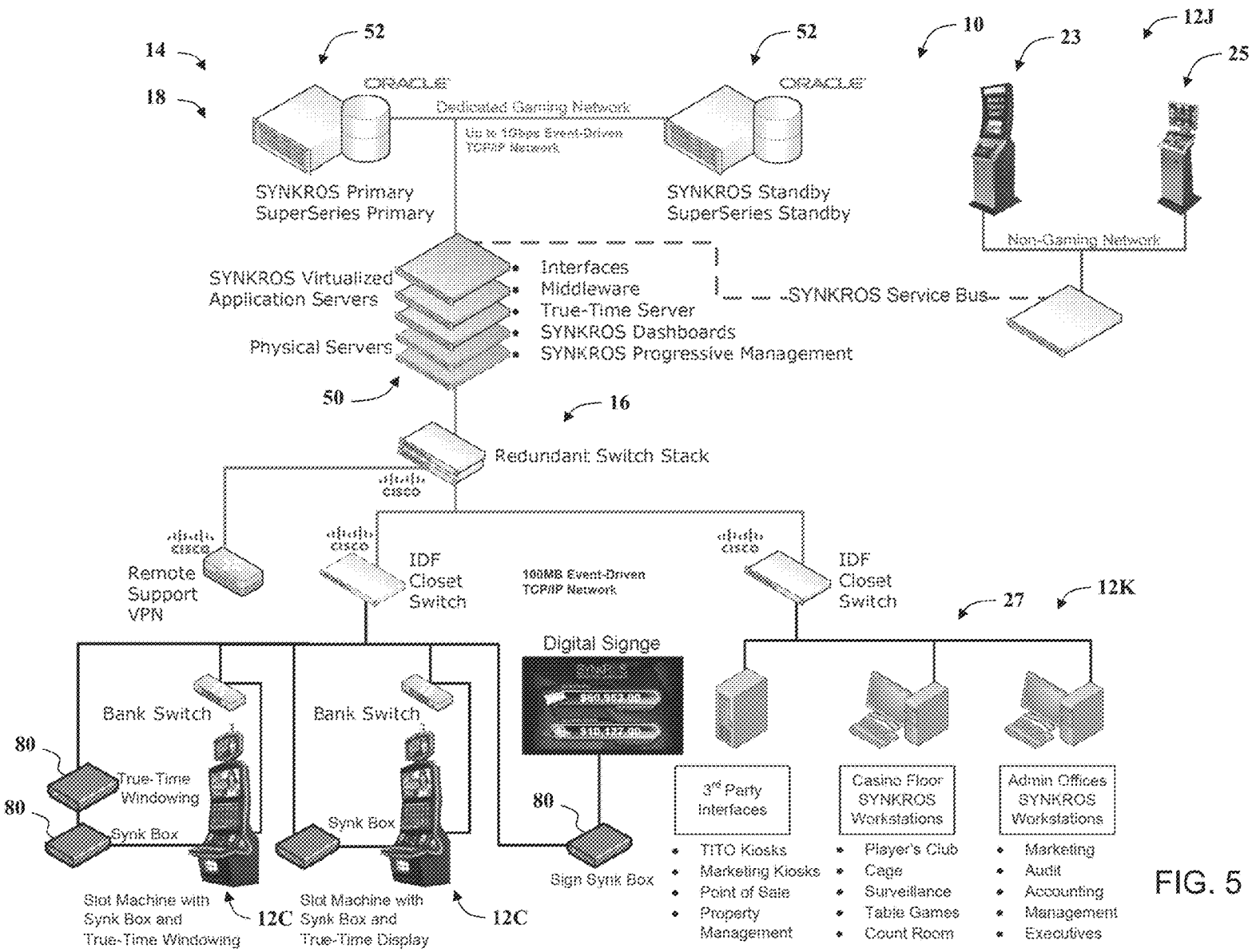
FIG. 5 is another schematic diagram of the networked computer system shown in FIG. 1, according to an embodiment of the present invention.
Figure 6:
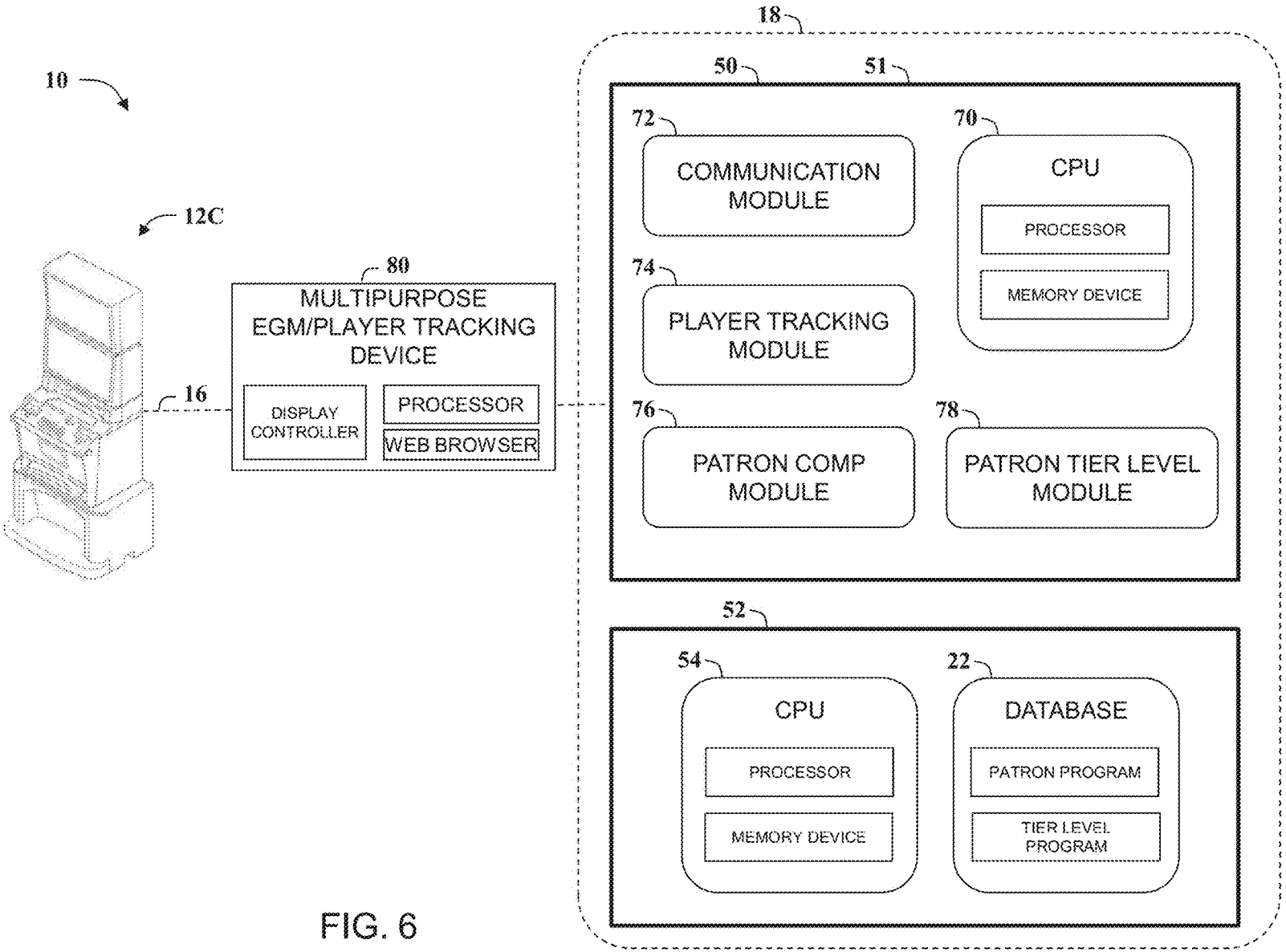
FIG. 6 is another schematic diagram of the system the system shown in shown in FIGS. 1-3 and 5 including a server computer system and a gaming machine, according to an embodiment of the present invention.

Referring to FIGS. 5 and 6, in one embodiment, the server computer system 18 includes one or more middleware application server computers 50 and one or more database server computers 52. The database server computer 52 includes a database server processor 54 that is coupled to a database memory device that includes the database 22. The database server processor 54 is programmed to retrieve and store information contained in the database 22. The database 22 contains information on a variety of matters, such as, for example, web pages associated with one or more websites, patron program files, patron account information, patron wagering information, patron ranking information, tier level program files, tier level data records, tier point program files, tier point accrual records, postal code information, patron comp point value information, patron purchasing information, and/or any suitable information that enables the system 10 to function as described herein.

The middleware application server computers 50 include a patron evaluation server computer 51 that includes a central processing unit (CPU) including an application processor 70 that is programmed to communicate with each of the gaming devices 12 and the database server computer 52. In the illustrated embodiment, the application processor 70 includes a communication module 72, a player tracking module 74, a patron comp module 76, and a patron tier level module 78. The application processor 70 includes one or more processors that are coupled to a memory device. In addition, the application processor 70 executes various programs, and thereby controls components of the server computer system 18 according to user instructions received from one or more devices 12 and/or the player tracking device 38 to enable users to interact with and operate the server computer system 18. For example, in the illustrated embodiment, the application processor 70 is programmed to receive player tracking data from one or more player tracking devices 38 and generate player tracking account records to monitor the amount of wagers and/or product purchase being made by the player.

In one embodiment, the system 10 includes a gaming tracking device 80 (SYNKBOX™) that is coupled to the gaming device 12 and the server computer system 18 to receive gaming property services from the server computer system 18 and display the gaming property services on the gaming display 36. Moreover, the gaming tracking device 80 is configured to receive gaming property services from the server computer system 18 and transmit services data indicative of the gaming property services to gaming device 12. In one embodiment, the gaming tracking device 80 is a multipurpose EGM/player tracking device that is connected to one or more gaming machines 12. In one embodiment, the gaming tracking device 80 includes a housing that contains a processor and a display controller configured to control and/or drive the gaming display 36 included with the gaming machine 12. For example, in one embodiment, the gaming tracking device 80 includes a True Time Windows™ computer program that drives a picture-in-picture gaming display 36. Additional details of multipurpose EGM/player tracking devices, which may be used in the present invention, are described in U.S. patent application Ser. No. 12/235,237 to Edward Sepich et al., now U.S. Pat. No. 8,429,229, filed Sep. 22, 2008, titled "Multipurpose EGM/player Tracking Device and System", which is incorporated herein by reference in its entirety.

The communication module 72 is programmed to communicate with the system devices 12 and/or player tracking devices 38 to facilitate transmitting data over the network 16. The communication module 72 is also programmed to access and retrieve information being stored in the database 22 and transmit information being received from, or generated by, the application processor 70 to the database server computer 52.

In one embodiment, the communication module 72 includes a web-browser program that generates and transmits software code including, but not limited to HTML, JavaScript, and/or any suitable programming code that enables the gaming machine 12, table management host workstation 27 for table games, kiosks 25, point of sale or redemption terminals 23, and/or other devices 12 to display a website and/or webpages. The communication module 72 may be programmed to host a website including webpages (shown in FIGS. 17-26) that are accessible by a user via one or more client devices 12. The communication module 72 executes a website application program that retrieves code from the database 22 and executes the application code to render one or more webpages on a display device of a client device 12 in response to requests received from the user via the client device 12 to allow users to interact with the website.

For example, in one embodiment, the communication module 72 may be configured to generate and display a web browser interface 82 (shown in FIGS. 17-26) on a client device 12 such as, for example, the gaming machine 12C, using the gaming tracking device 80. The web browser interface 82 enables a player to access the gaming property services via a website provided by the system 10. In one embodiment, the gaming tracking device 80 is configured to receive webpage data indicative of the gaming property services from the communication module 72 and transmit the services webpage to a gaming machine 12C for use in displaying the services webpage on the gaming display 36. In addition, the gaming tracking device 80 may be configured to transmit information between the patron and the server computer system 18 via the services webpage to facilitate providing gaming property services to the player.

Figure 17:
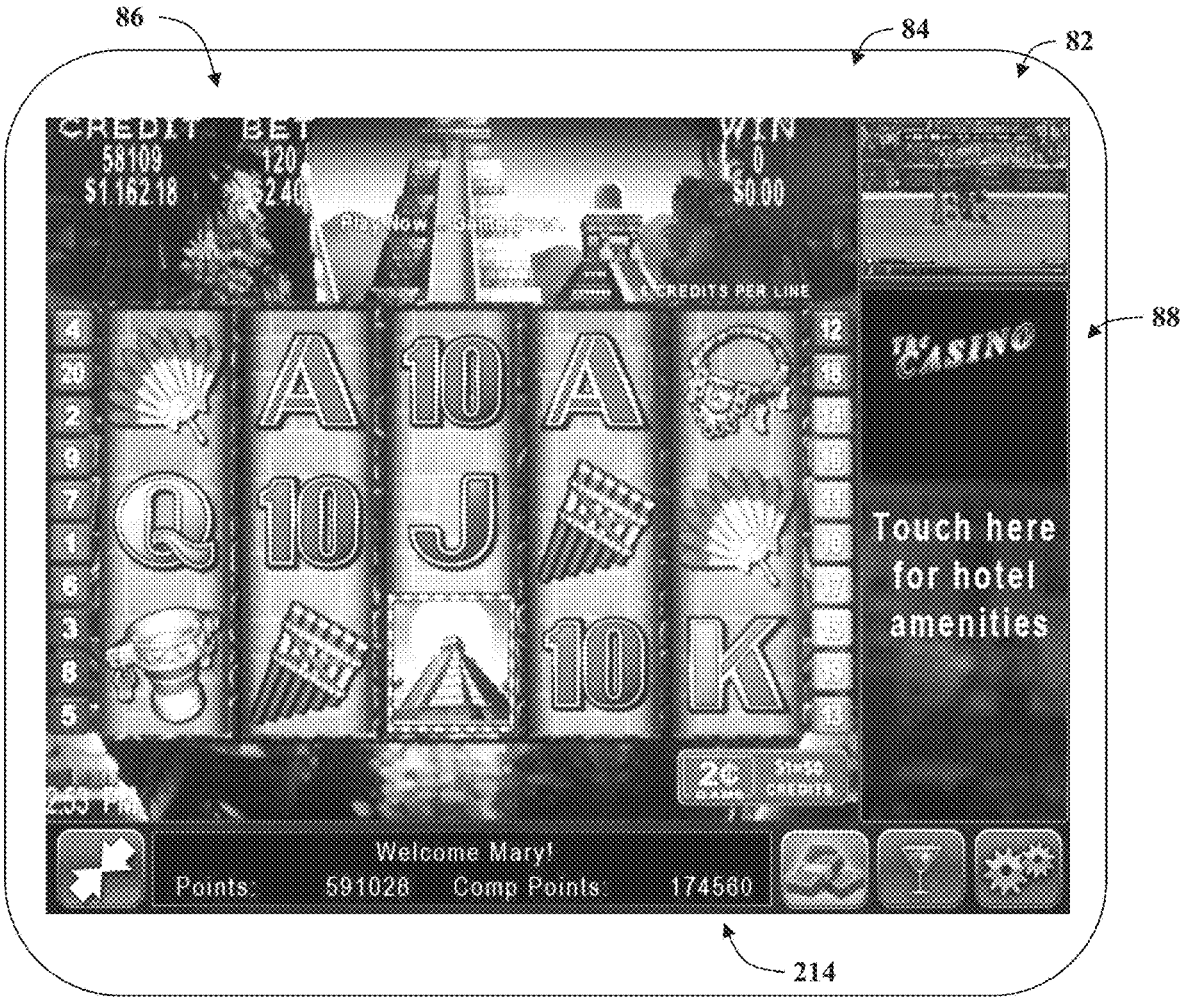
FIGS. 17-26 are graphical displays that may be displayed using the system shown in FIGS. 1-3, 5, and 6, according to an embodiment of the present invention.
Figure 18:
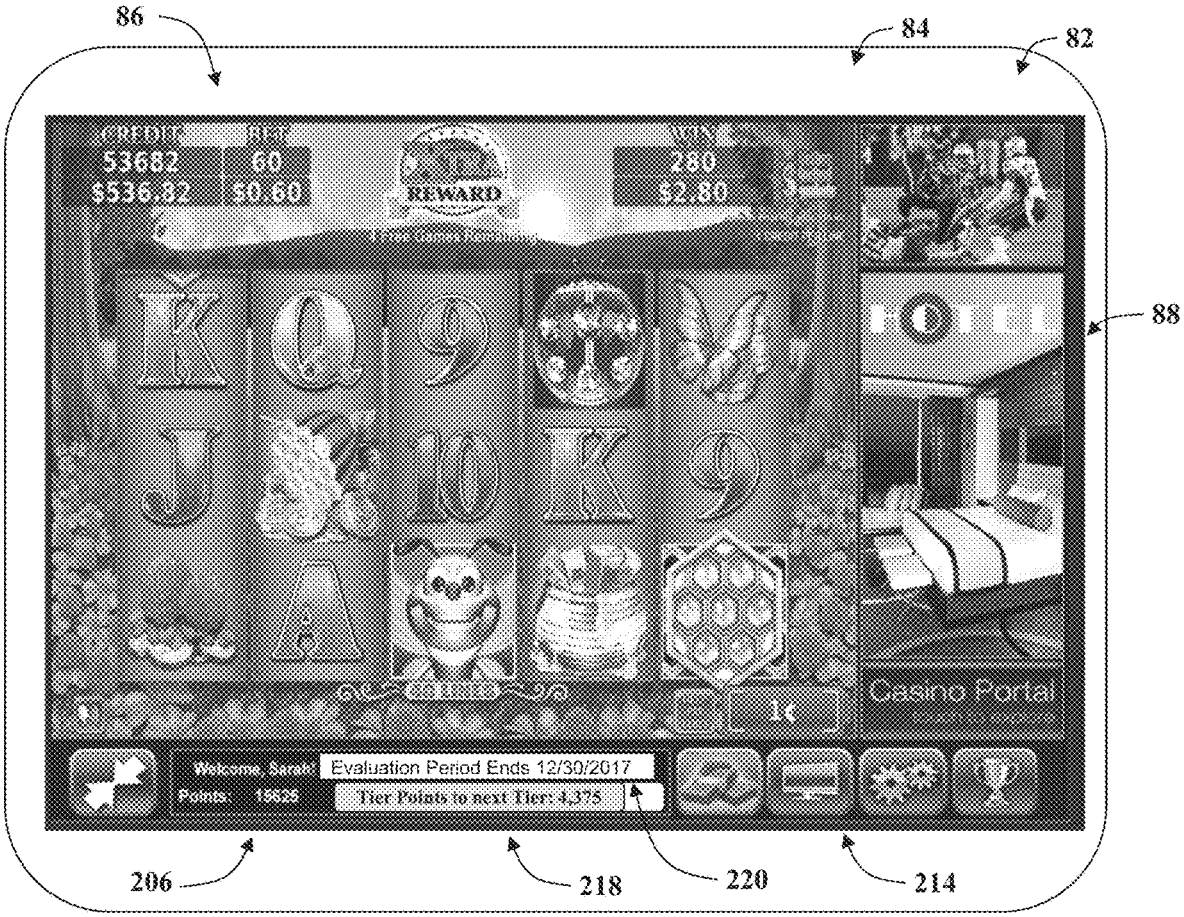
Figure 19:
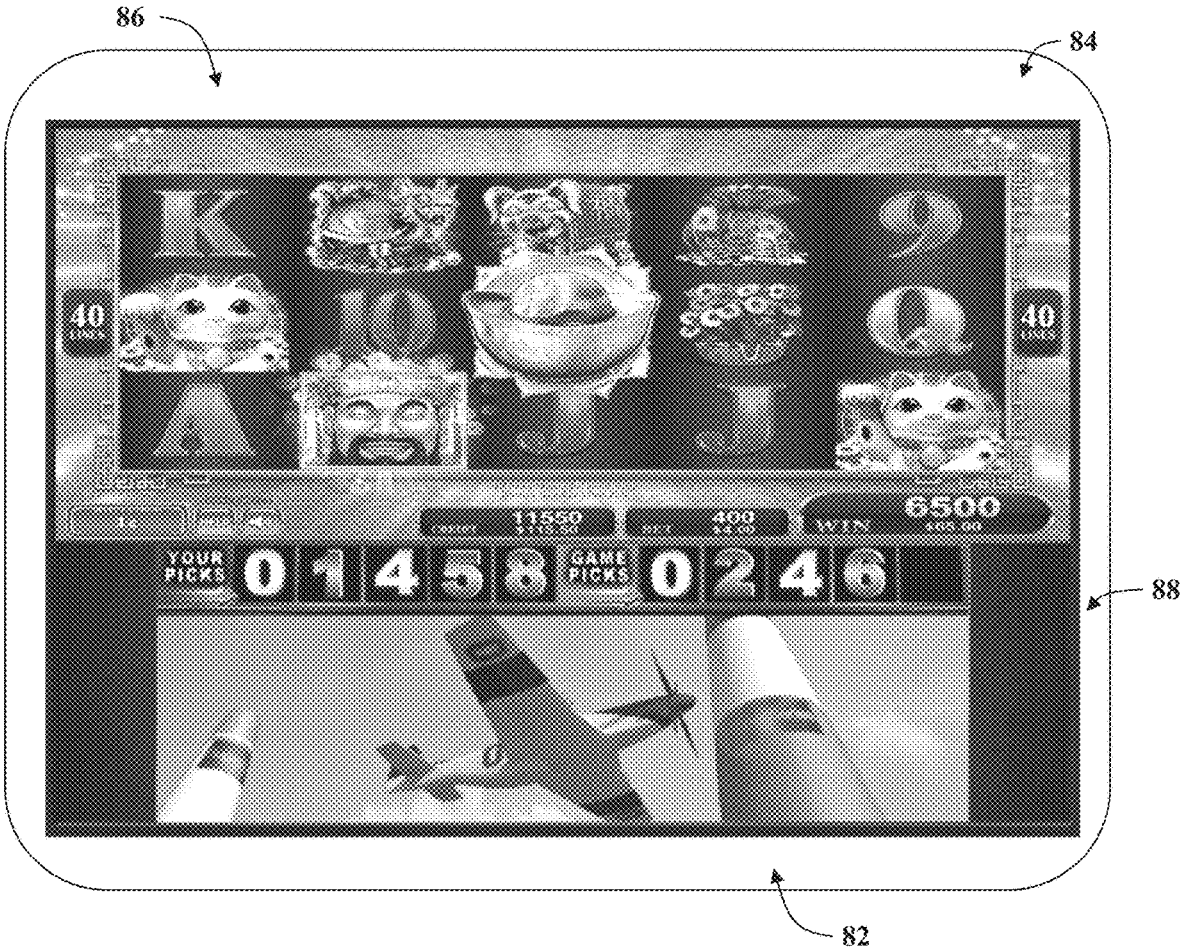

In the illustrated embodiment, the server computer system 18 is configured to display a player interaction screen 84 on the gaming machine 12C including a gaming content section 86 and a non-gaming content section 88 using a picture-in-picture display (shown in FIGS. 7 and 17-18). Moreover, the server computer system 18 displays a game being generated by the gaming controller 26 of the gaming machine 12 within the gaming content section 86 and displays a services website in the non-gaming content section 88. Additional details of the gaming tracking device 80 and system components for use in displaying the player interaction screen, which may be used in the present invention, are described in U.S. patent application Ser. No. 14/488,174 to Jeffrey D. George et al., filed Sep. 16, 2014, titled "System and Methods of Providing Player Services with Gaming Devices", which is incorporated herein by reference in its entirety.

In the illustrated embodiment, the patron tracking module 74 is configured to receive player tracking information from one or more player tracking devices 38 and execute a patron program file to generate player tracking accounts for use in storing the information received from the player tracking devices 38. For example, in one embodiment, the patron tracking module 74 is configured to generate a plurality of player tracking account records 90 (shown in FIG. 10) that is stored in database 22. Each player tracking account record 90 includes a unique player ID associated with a casino patron, address information associated with the casino patron including a corresponding postal code. Each player tracking account records 90 also includes player tracking data that includes information on the amount of wagers and type of games being played by the patron and/or an amount of goods and/or services being purchase by the patron. For example, as show in FIG. 10, each player tracking account record 90 may include one or more gaming transaction records 92. Each gaming transaction record 92 is associated with a transaction being made by the corresponding patron. Each gaming transaction record 92 may include information that indicates a transaction being made by the patron such as, for example, a purchase being made at a POS terminal associated with the casino, an amount of wagers being placed with a slot machine, and/or an amount of wagers being placed at a table game.

For example, in one embodiment, during operation, the patron may enter player information at a player tracking device 38 associated with a gaming machine 12 to initiate a gaming session to begin placing wagers on the games being provided by the gaming machine 12. The patron may enter player information by inserting a player card in to the player tracking device 38 and/or entering a unique player ID such as, for example, a username and password, or personal identification number (PIN). In another embodiment, the player may initiate a gaming session at a gaming table, and allow a casino employee enter player information into a player tracking device 38 and/or user computing device associated with the gaming table.

Upon receiving the player information, the patron tracking module 74 may access the database 22 to identify and retrieve a player tracking account record 90 associated with the player information including the unique patron ID. The patron tracking module 74 may then generate a gaming transaction record 92 including information associated with the gaming session including, but not limited to, a unique session ID, a date of the gaming session, a start time, and a game type. Upon completion of the gaming session, the player tracking device 38 and/or patron tracking module 74 receives information associated with amount of wagers being placed by the player during the gaming session and updates the gaming transaction record 92 to include an end time to the gaming session, and a total amount of wagers being placed.

The patron tracking module 74 is also configured to execute the patron program file to generate a patron account data table 94 (shown in FIG. 11) that is stored in database 22 that includes a plurality of patron account records 96. Each patron account record 96 includes information associated with a corresponding casino patron including, but not limited to, the unique patron ID, a patron name, birthdate, player card ID, current tier point value, and number of tier points required to next tier level.

The patron comp module 76 is configured to determine an amount of patron comp awards that may be provided to a patron by the casino based on an amount of wagers being placed and/or an amount of purchases being made by the patron over a predefined evaluation period. Patron comp awards may include, but are not limited to, bonus points, gaming credits, incentive points, and/or any suitable award that may be provided to the patron. For example, in one embodiment, bonus awards may be provided to a player and stored in a corresponding player account for use by the player to purchase goods and/or services offered by the gaming property and/or for placing wagers on games being played on the gaming machine. In one embodiment, bonus awards include bonus points that may include incentive points. Incentive points may be exchanged for game play, gifts and/or property services, such as hats, t-shirts, meals, shows, and/or property amenities such as spa/pool services, nightclub services, etc.

In another embodiment, the bonus points may also be convertible to gaming credits, which may be designated as cashable or non-cashable. Cashable credits, or incentive points converted into credits, may be downloaded to a gaming machine. When the player has finished playing the gaming machine, any remaining credits may be cashed out, i.e., retrieved as coins or placed on a printed ticket or player tracking card for redemption or play on another gaming machine. In addition, cashable credits may be used to purchase goods and/or services provided by the casino gaming property and/or $3^{rd}$ party vendors.

Non-cashable credits must be used for game play and/or wagering on games being played with the gaming machine. When the player stops playing a gaming machine, any remaining non-cashable credits which were downloaded to the gaming machine are either lost or uploaded back to the player account.

In the illustrated embodiment, the patron comp module 76 is configured to generate a bonus award data table 98 (shown in FIG. 12) that is stored in the database 22, and use the bonus award data table 98 to calculate bonus awards, such as, for example, patron comp awards, based on a current tier level associated with a patron. As shown in FIG. 12, in the illustrated embodiment, the bonus award data table 98 includes a plurality of tier level data records 100. Each tier level data record 100 includes data for use in calculating bonus awards including, but not limited to, bonus point awards per coin-in and comping reinvestment data including Slot Reinvest % including Percentage of Slot Theoretical Loss that will be awarded as a multiplier and Tables Reinvest % including Percentage of Tables Theoretical Loss that will be awarded as a multiplier.

In the illustrated embodiment, the patron tier level module 78 is configured to execute a tier point program file to generate a tier point accrual data table 102 (shown in FIG. 13) that is stored in the database 22. The tier point accrual data table 102 includes information that is used by the patron tier level module 78 for calculating tier values including tier points. For example, in the illustrated embodiment, the tier point accrual data table 102 includes a plurality of point accrual records 104. Each point accrual record 104 is associated with a different patron activity that may be monitored by the system 10 including, for example, player wagering at a slot game provided by a gaming machine 12, sports wagering activity at a sports book, and player wagering activity at a gaming table.

Referring to FIG. 14, in the illustrated embodiment, the patron tier level module 78 is also configured to execute a tier level program file to generate and store a patron tier level data table 106 in the database 22 that includes information associated with a plurality of tier levels associated with patron wagering activity. For example, in one embodiment, the patron tier level data table 106 includes a plurality of data records that include information associated with each tier level. The information associated with each tier level includes, but is not limited to, a card tier type, tier point range level, a theoretical loss value, actual loss value, evaluation period, and expiration period. In the illustrated embodiment, the patron tier level module 78 uses the information stored in the patron tier level data table 106 to determine a card tier level associated with a patron for use in determining bonus awards to be provided to the patron.

In one embodiment, the patron tier level module 78 may also be programmed to generate and store a tier level activity data table 108 (shown in FIG. 15) in the database 22 that includes information associated with a plurality of patrons including, but not limited to, the unique patron ID, a date in which the corresponding patron was evaluated for a tier level adjustment, an expiration date of the tier level, and an indication of whether the current tier level associated with the patron ID is frozen and/or restricted.

Referring to FIG. 16, in one embodiment, the patron tier level module 78 may also be programmed to generate and store a tier level history data table 110 in the database 22 including information associated with changes in the tier levels associated with the casino patrons. For example, the tier level history data table 110 may include information associated with a corresponding patron including, but not limited to, a corresponding unique patron ID, a date of the next scheduled tier level evaluation, a current tier level of the corresponding patron, a previous tier level, and a previous tier point value associated with the patron.

Figure 20:
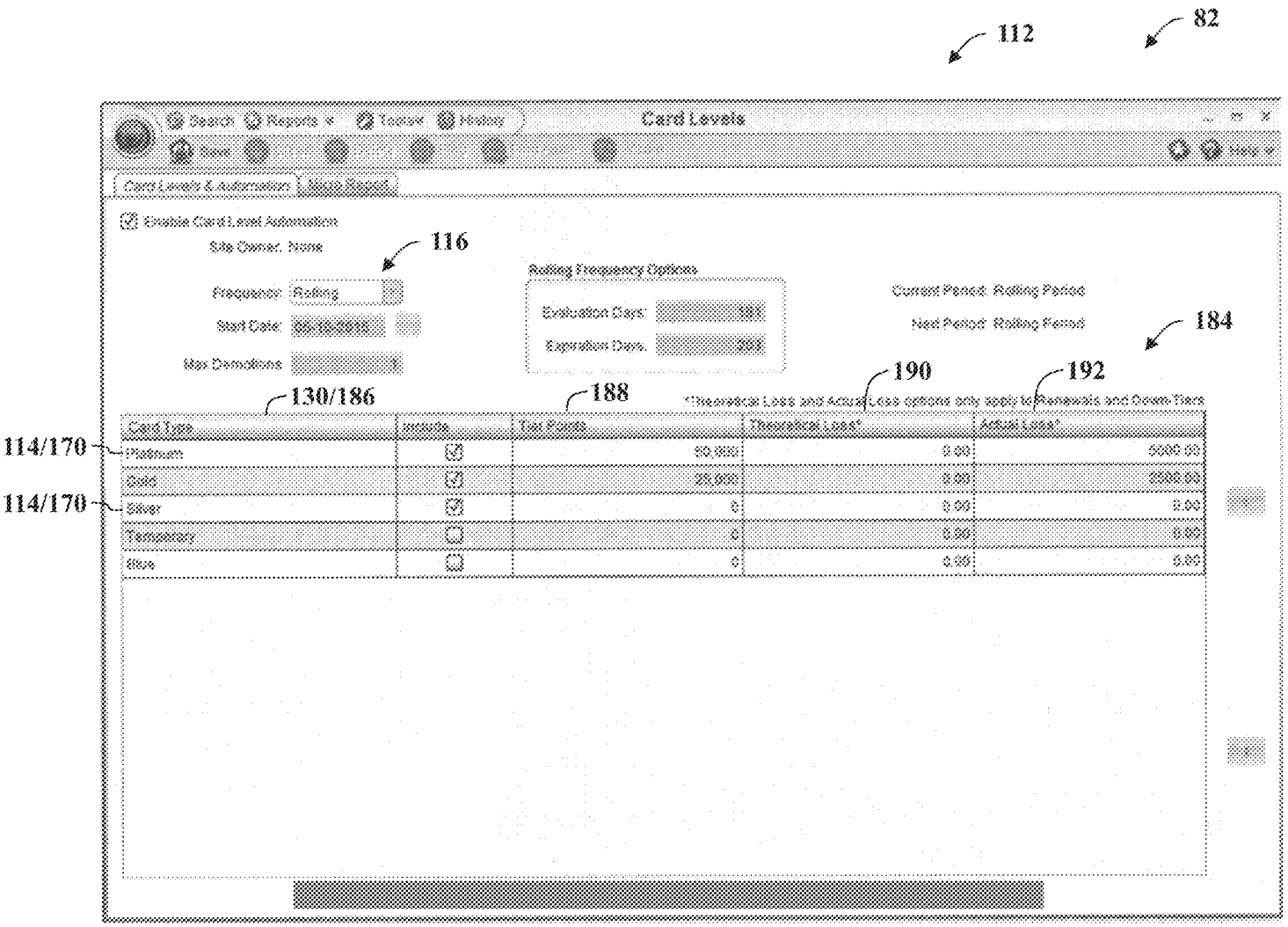

Referring to FIG. 20, in the illustrative embodiment, the server computer system 18 is configured to display a card level automation setup screen 112 to allow users to adjust an evaluation period and/or expiration period associated with patron card level tiers. For example, in one embodiment, upon receiving a request from the user to access current patron tier card levels, the patron tier level module 78 may access patron tier level data table 106 to retrieve information associated with patron tier levels 114 and generate and display the card level automation setup screen 112. The server computer system 18 may display the card level automation setup screen 112 to include a Rolling Period option 116 that may be selected by the user. If the user selects the Frequency of "Rolling Period" 116, the server computer system 18 is programed to display card level automation setup screen 112 to prompt the user to select Evaluation Days: Prompted for the Number of Days (Days to qualify); and Expiration Days: (Evaluation Days+a grace period to allow for patron notification). For references throughout the document, Total Period=Expiration Days. The card level automation setup screen 112 allows the user to manually adjust the number of evaluation days and the number of expiration days associated with each tier level. Upon receiving the selections from the user, the server computer system 18 modifies the patron tier level data table 106 to include the user's selections and stores the modified patron tier level data table 106 in the database 22.

Figure 21:
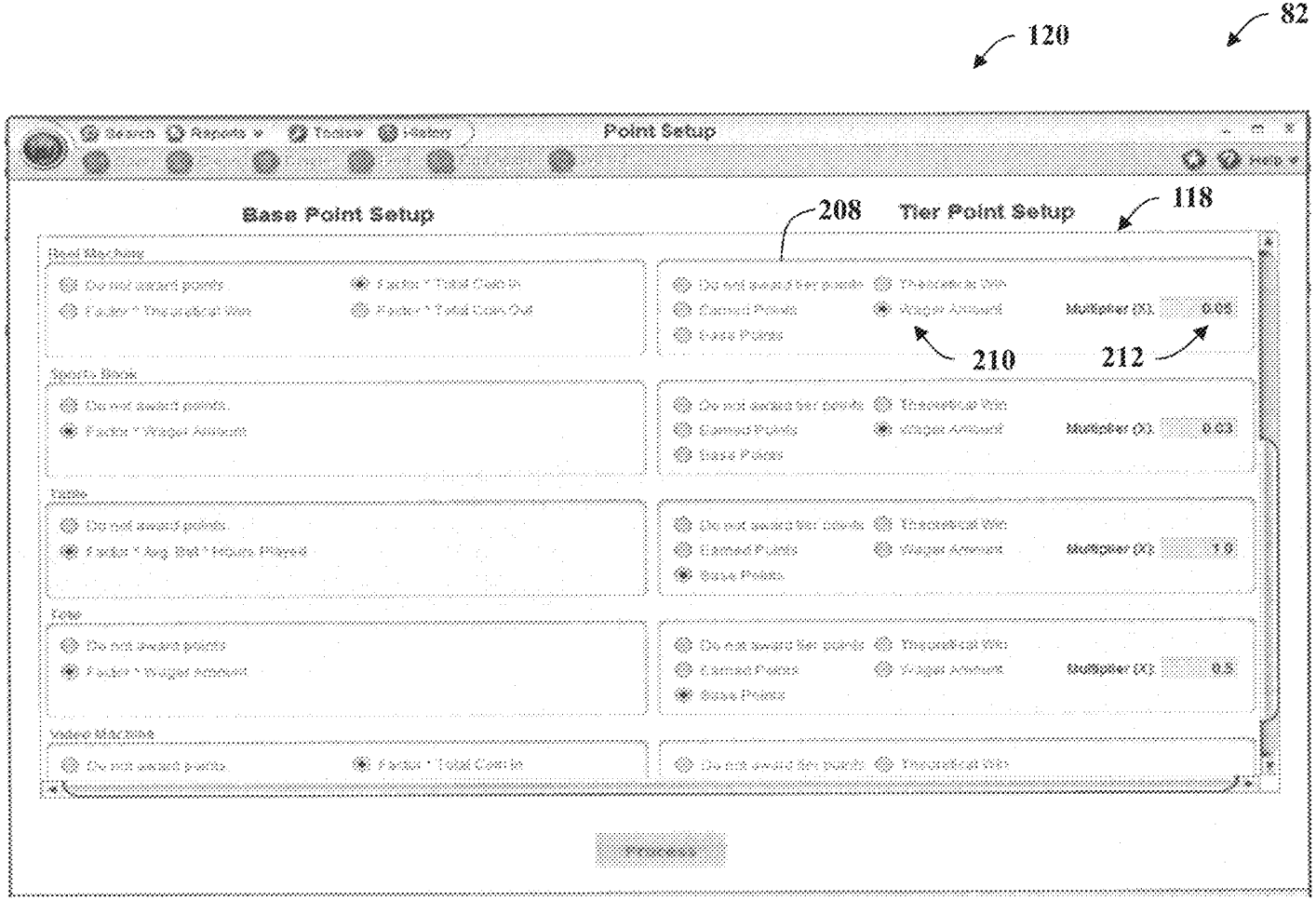

With reference to FIG. 21, in one embodiment, the server computer system 18 allows a user the define tier point accrual values 118 used in calculating tier points that may be accumulated by a patron. The tier points accumulated by a patron are used by the system 10 to determine a tier card level associated with the patron and to calculate bonus awards to be provided to the patron based on the patrons wagering activity over a period of time. For example, upon receiving a request from a user to adjust and/or define tier point accrual values 118, the server computer system 18 accesses the information included in the tier point accrual data table 102 and generates and displays a tier point setup screen 120 on a client device 12.

The tier point setup screen 120 displays the tier point accruals 118 associated with each patron tier level, and allows a user to define how a player accumulates tier points by wager type. For example, slot play may be configured to award tier points based on the Total Points, Base Points, or TheoWin of each slot rating. Additionally, the tier points can be multiplied by a factor. Upon receiving selected by the user, the server computer system 18 updates the tier point accrual data table 102 and stores the updated tier point accrual data table 102 in the database 22.

During operation of the system, as a player plays at a casino, with each slot, table or other wager (i.e., POS) if configured, the patrons current tier points balance is updated after the update or close of each wager rating. Their tier point balance continues to accrue until they are evaluated by the nightly process on their tier expiration date. The SYNKROS system 10 uses the tier point accruals 118 included in the updated tier point accrual data table 102 to monitor wagering activity of a player while a player is playing at the casino and earning Tier Points based on the accrual rates setup in Tier Point Setup Screen 120 by wager type.

Figure 22:
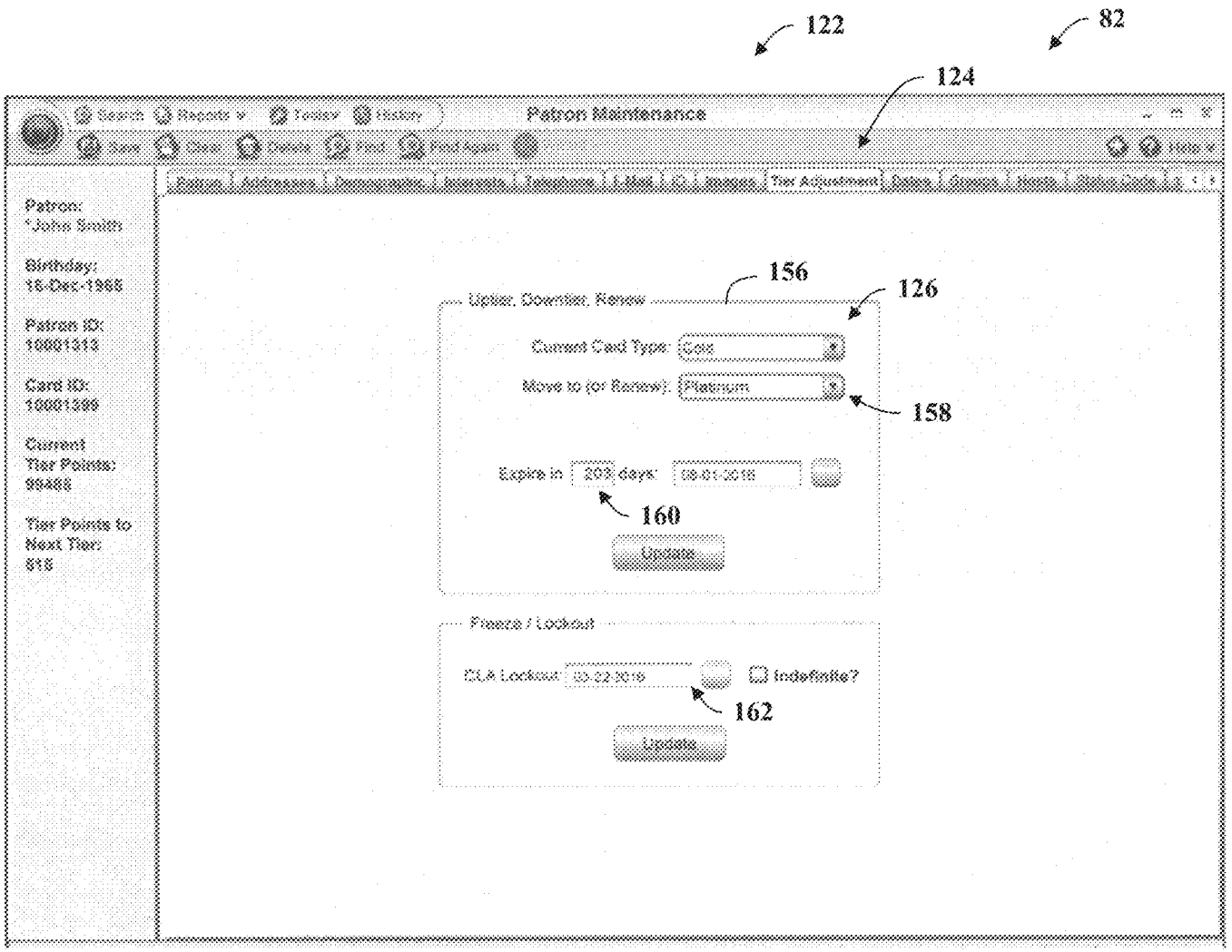

Referring to FIG. 22, in one embodiment, the server computer system 18 is configured to display a tier adjustment webpage 122 on a client device 12 to allow a user to view and adjust patron tier level activity associated with a patron. For example, upon receiving a request by a user to view patron information associated with a unique patron ID, the server computer system 18 may access the database 22 to retrieve the patron account data table 94, the tier level activity data table 108, and the tier level history data table 110 associated with the unique Patron ID, and generate and display the tier adjustment webpage 122 to information associated with the corresponding patron.

In the illustrated embodiment, the server computer system 18 displays the tier adjustment webpage 122 including a SYNKROS Account Tab/Tier Adjustment Tab 124 that displays a Status Bar (Left) which is configurable and can display various patron information including, but not limited to, a Patron name, Birthday, Patron ID, Card Id, Current Tier Points, and/or Tier Points to Next Tier. In addition, the tier adjustment webpage 122 includes a tier selection area 126 to allow the user to modify a tier value associated with the patron including an Up-tier, Down-tier, Renew prompt to: Changing the card tier Up-tier, Renewal (leaving it the same) or Down-tier; Resets the Expiration Date; Defaults to (current day+Expiration Days). The tier adjustment webpage 122 may also be used to set a specific CLA Lockout Date, or Set as an Indefinite Lockout. If "indefinite" is selected, the date will visually dim out. Upon receiving selections from the user via the tier adjustment webpage 122, the server computer system 18 updates the patron account data table 94, the tier level activity data table 108, and the tier level history data table 110 to include the changes made by the user to the corresponding Patron information.

Figure 4:
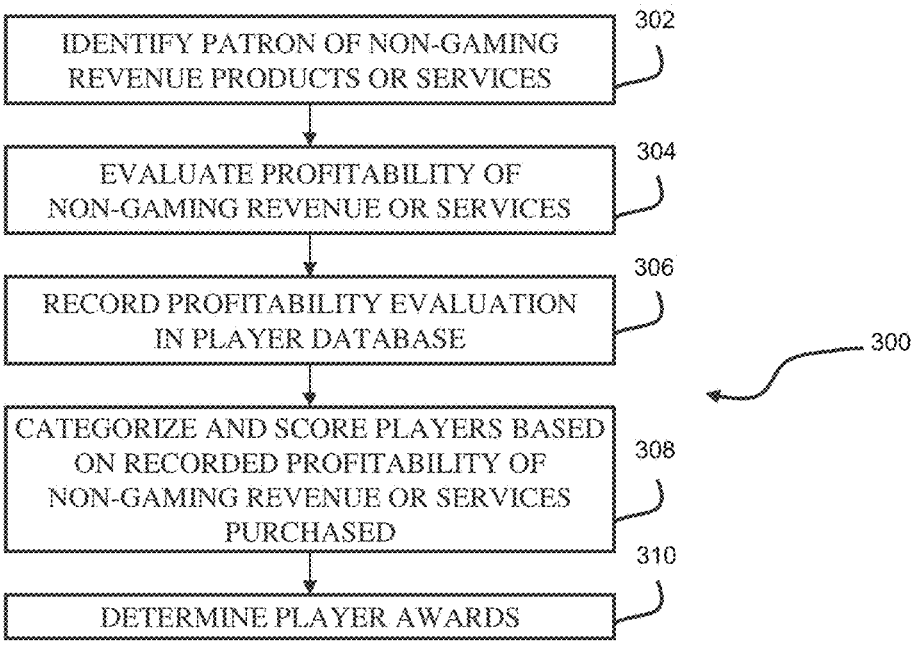
FIG. 4 is a flow diagram of a method for tracking non-gaming activities of a patron at a resort that may be executed by the system shown in FIG. 1, according to an embodiment of the present invention.
Figure 8:
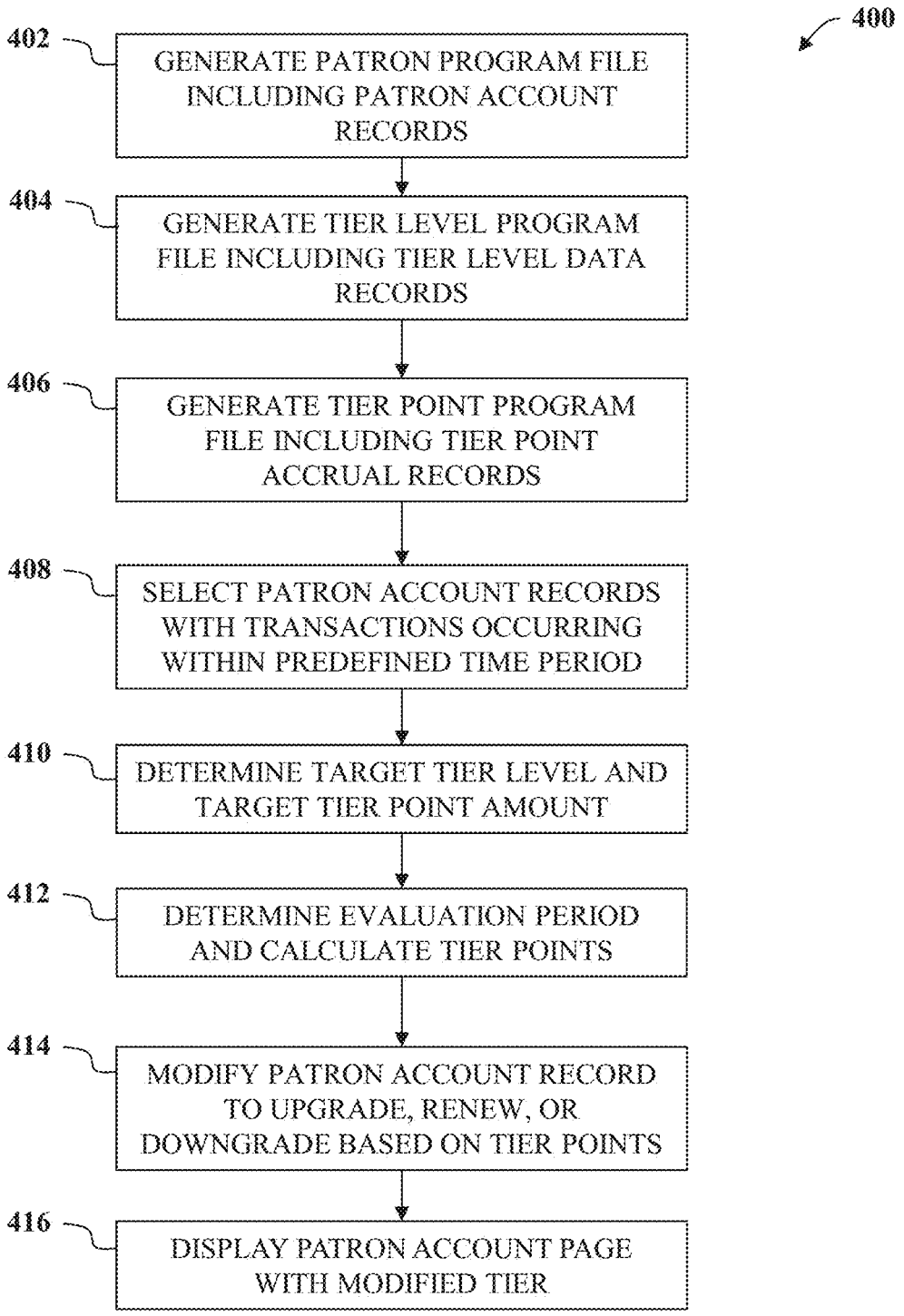
FIGS. 8-9 are flowcharts of methods that may be used with the system shown in FIGS. 1-3, 5, and 6, according to an embodiment of the present invention.
Figure 9:
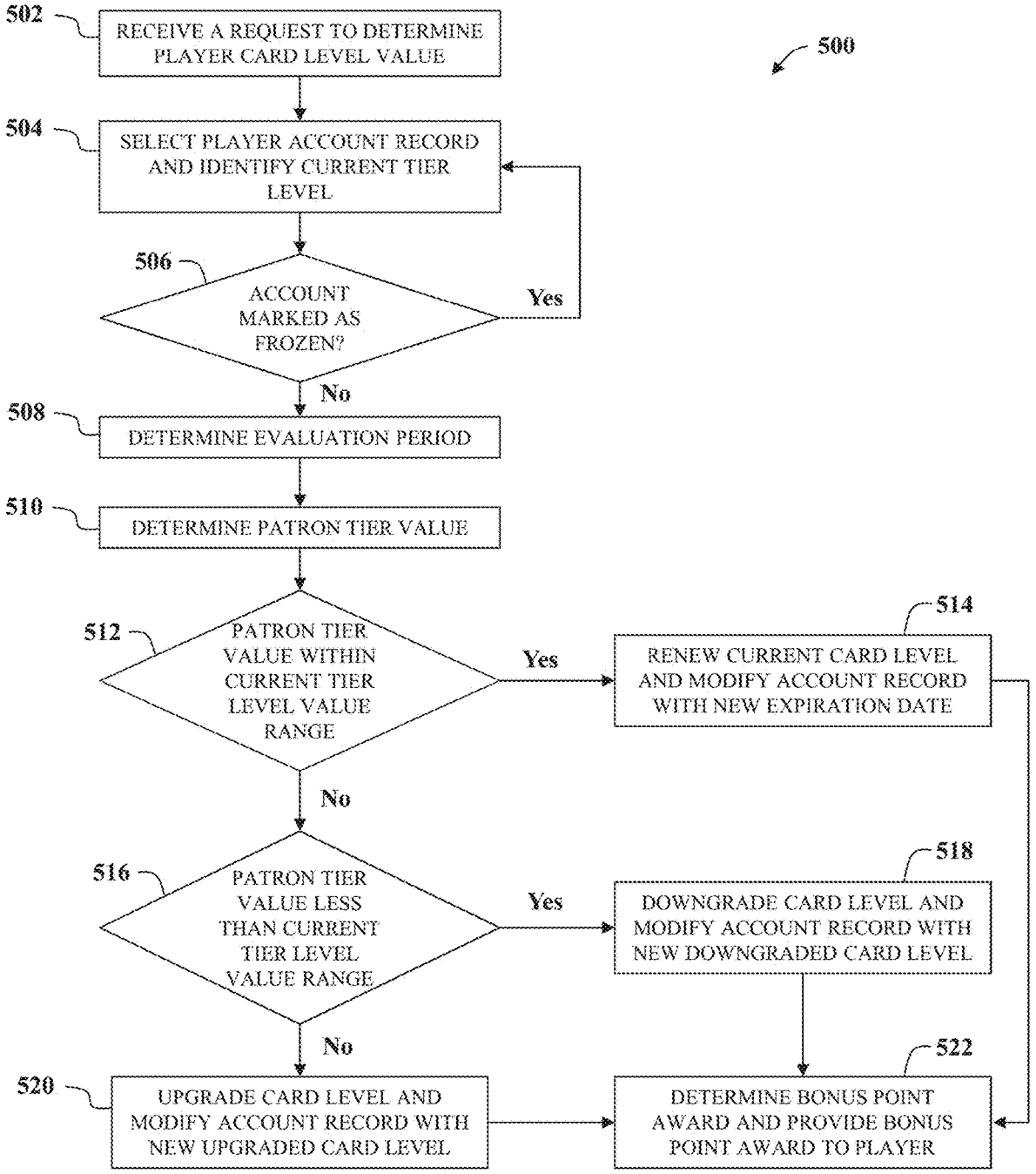

FIGS. 4, 8, and 9 are flowcharts of methods 300, 400, and 500 that may be used with the server computer system 18 for use in generating information that may be used to provide gaming property services to a casino patron. The methods 300, 400, and 500 include a plurality of steps. Each method step may be performed independently of, or in combination with, other method steps. Portions of the methods 300, 400, and 500 may be performed by any one of, or any combination of, the components of the system 10.

Referring to FIG. 4, in one embodiment, in method step 302, the server computer system 18 identifies a patron generating non-gaming revenue by purchasing non-gaming goods and services using one or more non-gaming devices 12. In method step 304, the server computer system 18 evaluates the profitability of the non-gaming revenue or non-gaming services. In method step 306, the server computer system 18 generates a gaming transaction record 92 associated with the non-gaming purchase and updates a corresponding player tracking account record 78 stored in the database. In method step 308, the server computer system 18 categorizes and generates a patron ranking and/or player score based on the recorded profitability of the non-gaming revenue or services purchased. In method step 310, the server computer system 18 determines a patron comp award to be provided to the player based on the player ranking and/or player score.

Referring to FIG. 8, in the illustrated embodiment, in method step 402, the server computer system 18 is configured to generate a patron program file 94 including patron data records. For example, in one embodiment, the database server computer 52 is programmed to generate and store the patron program file 94 including a plurality of patron account records 96 (shown in FIG. 11). The database server computer 52 may generate the patron account records 96 to include information included in the player tracking account record 90, the patron account data table 94, the tier level activity data table 108, the tier level history data table 110, and/or any suitable information generated by the patron evaluation server computer 51 and/or the server computer system 18.

In the illustrated embodiment, each patron account record 96 is generated to include a unique patron ID 128 associated with a patron, a tier level indicator 130, and patron wagering data 132. The tier level indicator 130 is associated with a tier level 134 (shown in FIG. 12) assigned to the patron account record 96 and is selected from a ranked group of tier levels 134. Each of the ranked group of tier levels 134 is associated with a plurality of award benefits provided by a casino property to the patron. For example, in one embodiment, the patron evaluation server computer 51 may use the tier level indicator 130 is associated with the patron to select a tier level data record 100 to calculate bonus awards based on the information included in the tier level data record 100 such as, for example, the bonus point awards per coin-in data 136 and comping reinvestment data 138. For example, as shown in FIG. 12, the ranked group of tier levels 134 may include a "Gold" tier level, a "Platinum" tier level, and a "Diamond" tier level. The "Diamond" tier level includes a higher bonus point awards per coin-in data value than the "Platinum" tier level and the "Gold" tier levels, indicating a greater amount of award benefits provided to a patron assigned to the "Diamond" tier level, as compared to patrons assigned to the "Platinum" tier level or the "Gold" tier level.

In one embodiment, the database server computer 52 is programmed to generate the patron wagering data 132 including a plurality of gaming transaction records 92 (shown in FIG. 10). For example, the database server computer 52 may link the patron account record 96 with the player tracking account record 90 using the unique patron ID 128, such that when a patron account record 96 is accessed by the server computer system 18, a corresponding player tracking account record 90 associated with the patron may also be identified and accessed using the corresponding unique patron ID 128. In one embodiment, the database server computer 52 may be programmed to generate the patron account record 96 to include the gaming transaction records 92 included in a corresponding player tracking account record 90. Each gaming transaction record 92 includes a transaction date 140 and a wager amount 142 of a corresponding gaming transaction. As shown in FIGS. 10 and 13, the database server computer 52 may also be programmed to generate each gaming transaction record 92 including a wagering transaction type 144 indicating the type of activity associated with the gaming transaction. For example, in one embodiment, the wagering transaction type 144 may include reel machine wager indicator 146 associated with a slot machine, such as for example, gaming machine 12C, and a table game wager indicator 148 associated with table game wagering activity.

In the illustrated embodiment, the database server computer 52 generates the patron account record 96 to include a last evaluation date value 150 and a tier expiration date value 152 (shown in FIG. 15). The last evaluation date value 150 indicates a previous date in which the tier level associated with the patron account record 96 was evaluated and/or the previous date in which the tier level indicator 130 was modified. The tier expiration date value 152 indicates a date in which the tier level and/or tier level indicator 130 associated with the patron account record 96 is scheduled to be evaluated by the patron evaluation server computer 51. For example, the database server computer 52 may be programmed to generate the patron account record 96 to include the information included in the tier level activity data table 108 including, the unique patron ID 128, the last evaluation date value 150 including a date in which the corresponding patron was evaluated for a tier level adjustment, and the tier expiration date value 152.

In one embodiment, the database server computer 52 is programmed to generate the patron account record 96 including a lockout designator 154 (shown in FIG. 15) indicating whether the patron account record 96 is eligible for a tier level adjustment. For example, the database server computer 52 may be programmed to generate the patron account record 96 to include the information included in the tier level activity data table 108 including, the unique patron ID 128 and the lockout designator 154 indicating whether the current tier level associated with the patron ID is frozen and/or restricted.

In the illustrated embodiment, the patron evaluation server computer 51 is programmed to display the tier adjustment webpage 122 to receive user defined inputs that may be used to generate information included in the patron account record 96. For example, the patron evaluation server computer 51 may access the patron program file 94 upon receiving a request from a user via a user computing device 12 and retrieve a patron account record 96 associated with a unique patron ID 128 requested by the user. The patron evaluation server computer 51 may then generate and display the tier adjustment webpage 122 including information associated with the retrieved patron account record 96. For example, as shown in FIG. 22, in one embodiment, the patron evaluation server computer 51 is programmed to display the tier adjustment webpage 122 including a current card type display field 156, a tier adjustment selector 158, and an expiration date input field 160. The current card type display field 156 is adapted to display a current tier level indicator 130 associated with the retrieved patron account record 96. The tier adjustment selector 158 may include a drop-down menu including a plurality of tier level indicators 130 that are selectable by the user and associated with the ranked group of tier levels 134. The expiration date input field 160 is adapted to receive a user defined date value associated with a tier expiration date value 152. In one embodiment, the patron evaluation server computer 51 displays the tier adjustment webpage 122 including a lockout indicator display field 162 that is adapted to receive a user defined date value associated with an amount of time the patron account record 96 may be frozen and/or restricted.

In the illustrated embodiment, the patron evaluation server computer 51 is programmed to receive a user selection of a tier level indicator 130 being displayed in the tier adjustment selector 158 drop-down menu and receive a user input of a number of days via the expiration date input field 160. The patron evaluation server computer 51 updates the retrieved patron account record 96 by setting the current tier level indicator 130 included in the retrieved patron account record 96 to the user selected tier level indicator, and setting the tier expiration date value 152 to the sum of the current date, i.e. the date in which the user accesses the patron account record 96 via the tier adjustment webpage 122, and the number of days input via the expiration date input field 160. For example, the patron evaluation server computer 51 determines the current date when the user is accessing the patron account record 96 via the tier adjustment webpage 122 and adds the number of days input via the expiration date input field 160 to the current date to calculate the tier expiration date value 152. The patron evaluation server computer 51 also receives a user defined date value via the lockout indicator display field 162 and defines a lockout designator 154 and a lockout expiration date 164 in the patron account record 96 based on the user defined values received via the lockout indicator display field 162.

The patron evaluation server computer 51 then transmits the updated patron account record 96 to the database server computer 52 to store in the database 22. In one embodiment, the patron evaluation server computer 51 may transmit the user defined inputs received via the tier adjustment webpage 122 to the database server computer 52. The database server computer 52 then retrieves the patron account record 96 associated with the unique patron ID 128 from the database 22 and updates the retrieved patron account record 96 based on the user defined inputs received from the patron evaluation server computer 51.

In method step 404, the server computer system 18 is configured to generate and store a tier level program file 168 (shown in FIG. 14) including a plurality of tier level data records 170. For example, in one embodiment, the database server computer 52 is programmed to generate and store the tier level program file 168 including a plurality of tier level data records 170 including information included in the patron tier level data table 106. In the illustrated embodiment, each tier level data record 170 is associated with a tier level 134 and includes a tier level indicator 130 associated with a corresponding tier level 134, a tier point amount 172, a tier point level range 174, a theoretical loss value 176, an actual loss value 178, an evaluation period 180 including a number of days, and a renewal period 182 including a number of days. The tier point amount 172 and tier point level range 174 indicate a number of tier points that are associated with the corresponding tier level 134. For example, the tier point amount 172 indicates the number of tier points that must be obtained during an evaluation period 180 to obtain and/or maintain the corresponding tier level 134. Similarly, the tier point level range 174 indicates a range of tier points that that must be obtained during an evaluation period 180 to obtain and/or maintain the corresponding tier level 134. The theoretical loss value 176 indicates a total theoretical loss associated with the total amount wagers made during the evaluation period 180. The actual loss value 178 indicates an actual loss of wagered amounts made during the evaluation period 180.

The evaluation period 180 indicates the number of days that are included in a corresponding evaluation period that is used to identify gaming transactions 92 that may be used to determine corresponding tier point values included in patron account records. The renewal period 182 indicates a number of days in which a corresponding tier level may be active. For example, as shown in FIG. 14, a tier level data record 170 associated with a "Platinum" tier level may include an evaluation period 180 including 181 days, indicating that gaming transactions occurring within a previous 181 days are selected for use in determining tier level points. In addition, the tier level data record 170 associated with a "Platinum" tier level may also include a renewal period 182 including 203 days, indicating that the "Platinum" tier level will remain active for a period of 203 days from initiate activation and/or renewal. The renewal period 182 is also used to select patron account records 96 for tier renewal operations.

In the illustrated embodiment, the database server computer 52 generates the tier level program file 168 to include one or more tier level data records 170 having different evaluation periods 180. For example, the database server computer 52 may generate a first tier level data record 170 associated with a first tier level 134 and including a first evaluation period, and generate a second tier level data record 170 associated with a second tier level 134 and including a second evaluation period that is different than the first evaluation period. As shown in FIG. 14, in one embodiment, the database server computer 52 may generate the tier level program file 168 to include a tier level data record 170 associated with a "Platinum" tier level that has a different evaluation period 180 (e.g. 181 days) than the tier level data record 170 associated with the "Gold" tier level, e.g. 90 day evaluation period. In addition, the tier level program file 168 may include a tier level data record 170 associated with the "Platinum" tier level that has a different renewal period 182 (e.g. 203 days) than the tier level data record 170 associated with the "Gold" tier level, e.g. 120 day renewal evaluation period.

In the illustrated embodiment, the patron evaluation server computer 51 is programmed to receive a request from a user to view and/or modify one or more tier level data records 170, and access the tier level program file 168 and display a tier level setup webpage 112 to the user via a user computing device 12. The tier level setup webpage 112 displays a tier level matrix 184 that includes a plurality of rows and a plurality of columns intersecting the plurality of rows to define a plurality of logic cells 186. Each row corresponds to a tier level data record 170. The tier level setup webpage 112 displays each tier level data record 170 including a tier point logic cell 188 adapted to receive a user defined value associated with an amount of tier points, a theoretical loss logic cell 190 adapted to receive a user defined value associated with a theoretical loss amount, and an actual loss logic cell 192 adapted to receive a user defined value associated with an actual loss amount. In the illustrated embodiment, upon receiving user defined values input by a user via the corresponding logic cells 186, the patron evaluation server computer 51 modifies the corresponding values included in the corresponding tier level data record 170 and transmits the modified tier level data records 170 to the database server computer 52 to store in the database 22. For example, in one embodiment, upon receiving a user defined tier point value in the tier point logic cell 188, the patron evaluation server computer 51 may set the tier point amount 172 of the corresponding tier level data record 170 to the user defined tier point value. Similarly, upon receiving a user defined theoretical loss value in the theoretical loss logic cell 190, and receiving a user defined actual loss value in the actual loss logic cell 192, the patron evaluation server computer 51 may set the theoretical loss value 176 and the actual loss value 178 of the corresponding tier level data record 170 to the user defined theoretical loss value and actual loss value, respectively. In one embodiment, the patron evaluation server computer 51 may transmit the user defined values received via the tier level setup webpage 112 to the database server computer 52 for use in modifying the corresponding tier level data records 170 included in the database 22.

In method step 406, the server computer system 18 is configured to generate and store a tier point program file 102 (shown in FIG. 13) that may be used to determine a tier level 134 assigned to a patron. For example, in one embodiment, the database server computer 52 may be programmed to generate and store the tier point program file 102 including a plurality of tier point accrual records 104. Each tier point accrual record 104 is generated to include a wagering transaction type 144, a tier point calculation method indicator 194, and a corresponding multiplier value 196. The wagering transaction type 144 indicates a type of wagering activity. For example, the wagering transaction type 144 may include reel machine wager indicator 146 associated with a slot machine, such as for example, gaming machine 12C, and a table game wager indicator 148 associated with table game wagering activity. The tier point calculation method indicator 194 indicates a type of tier point calculation method that may be used by the patron evaluation server computer 51 to calculate tier points based on the corresponding wagering transaction type 144. For example, as shown in FIGS. 13 and 21, tier point calculation methods may include, but are not limited to, calculating tier points as a function of total coin-in, total coin out, total wager amount, average bet per hours played, theoretical win, and/or earned base points.

In the illustrated embodiment, the plurality of tier point accrual records 104 includes a reel machine accrual record 198 that includes a reel machine multiplier value 200 and a table game accrual record 202 that includes a table game multiplier value 204. The reel machine multiplier value 200 is used with the reel machine wager data 146 included in the gaming transaction records 92 for calculating tier point amounts 206 and the table game multiplier value 204 is used with the table game wager data 148 included in the gaming transaction records 92 for calculating tier point amounts 206.

In the illustrated embodiment, the patron evaluation server computer 51 is programmed to receive a request from a user to view and/or modify one or more tier point accrual records 104, and access the tier point program file 102 and display a tier point setup webpage 120 (shown in FIG. 21) to the user via a user computing device 12. The patron evaluation server computer 51 displays the tier point setup webpage 120 to include a tier point input field 208 associated with each wagering transaction type 144. Each tier point input field 208 includes a plurality of tier point calculation selectors 210 associated with a corresponding tier point calculation method, and a multiplier value input field 212. For example, in one embodiment, the tier point setup webpage 120 includes a reel machine tier point input field 208 including a plurality of reel machine tier point calculation selectors 210 and a reel machine multiplier value input field 212. Each of the plurality of reel machine tier point calculation selectors 210 is associated with a different tier point calculation method. In the illustrated embodiment, the patron evaluation server computer 51 receives a user selection of a tier point calculation selector 210 via the tier point setup webpage 120, receives a user defined reel machine multiplier value via the reel machine multiplier value input field 212, and updates the reel machine accrual record 198 to include in the tier point program file 102 to set a reel machine tier point calculation method to the user selected tier point calculation method and set the reel machine multiplier value 200 to the user defined reel machine multiplier value.

In the illustrated embodiment, the patron evaluation server computer 51 is programmed to execute a tier review operation to modify patron account records 96 to renew, downgrade, or upgrade the tier level 134 associated with patron account records 96. In the illustrated embodiment the, the patron evaluation server computer 51 executes the tier review operation by implementing the algorithm show in methods steps 408-416. In method step 408, the patron evaluation server computer 51 initiates the tier review operation by accessing the plurality of patron account records 96 being stored in the database 22 and selecting patron account records 96 having gaming transactions 92 that occur within a predefined period of time. In one embodiment, for example, the patron evaluation server 51 is programmed to select patron account records 96 including gaming transactions 92 occurring within a previous twenty-four hour period from the current date and/or time of the initiation of the tier review operation.

In method step 410, the patron evaluation server 51 evaluates each of the selected patron account records 96 and, for each selected patron account record 96, determines a current tier level indicator 130 included in the selected patron account record 96. The patron evaluation server 51 accesses the tier level program file 168, determines a target tier level 134 having a higher ranking than a tier level associated with the current tier level indicator 130, and selects a tier level data record 170 associated with the target tier level 134. The patron evaluation server 51 then identifies a tier point amount 172 and an evaluation period 180 associated with the target tier level 134.

In method step 412, the patron evaluation server 51 accesses the patron account record 96 and retrieves gaming transactions 92 having transaction dates occurring within the identified evaluation period 180 and calculate an amount of tier points based on the retrieved gaming transactions 92.

In method step 414, the patron evaluation server 51 modifies the selected patron account record 96 to upgrade, renew, or downgrade the tier level assigned to the patron account record 96 based on a comparison between the calculated amount of tier points and the tier point amount 172 associated with the target tier level 134.

In method step 416, the patron evaluation server 51 displays a patron account webpage 214 (shown in FIGS. 17, 18, 24, and 25) including the modified patron account record 96. For example, in one embodiment, as shown in FIGS. 17, 18, 24, and 25) the patron evaluation server 51 may display the patron account webpage 214 including the information included in the modified patron account record 96 in the non-gaming section 88 of the player interaction screen 84 being displayed on a gaming machine 12C. In another embodiment, as shown in FIGS. 23-24, the patron evaluation server 51 may display the patron account webpage 214 on the player tracking device display 46. For example, in one embodiment, patron evaluation server 51 may display a patron login screen 216 (shown in FIG. 23) on a player tracking device 38 associated with a gaming machine 12C, which requests a patron's unique patron ID to access a player tracking account. The patron evaluation server 51 may also display the patron login screen 216 on a non-gaming machine such as, for example, a user computer device 12, an admin workstation 27, and/or kiosk 25. The patron evaluation server 51 may obtain the patron's unique patron ID from input received via a numeric keypad displayed with the patron login screen 216, a code contained in a magnetic card strip of a physical card inserted into the card reader of the player tracking device 38, and/or a username and password entered via the patron login screen 216.

Upon receiving the unique patron ID, the patron evaluation server 51 may access the patron program file 94 and retrieve the patron account record 96 associated with the received patron ID, and display the patron account webpage 214 including information included in the retrieved patron account record 96 including, but not limited to, a current tier level, current tier point amount, and/or an amount of tier points required to obtain the next highest tier level. In one embodiment, the patron evaluation server 51 display the patron account webpage 214 including a progress bar 218 indicating a number of tier points required to reach the next highest tier level and displays the renewal date 220.

In one embodiment, the patron evaluation server 51 accesses the tier level history data table 110 and modifies the tier level history data table 110 to include information indicated changes in the tier levels of the modified patron account records 96. The patron evaluation server 51 may be programmed to display a patron information webpage 222 (shown in FIG. 26) including the information included in the tier level history data table 110 to display the changes in tier levels of modified patron account records 96.

Referring to FIG. 9, in one embodiment, the server computer system 18 may be programmed to execute the tier review operation by implementing the algorithm show in method steps 502-522. For example, in method step 502, the server computer system 18 receives a request to determine a player card level value indicating a patron comp award associated with a patron ranking. In one embodiment, the server computer system 18 may automatically perform nightly review of patron records and/or may receive a request from a patron or casino employee via a user computing device. In one embodiment, the request may include a unique patron ID associated with the patron.

In method step 504, the server computer system 18 accesses the database and accesses the patron account data table 94 in database 22 and retrieve a patron records 96 associated with the received Patron ID, and determines a current tier level associated with the corresponding patron. For example, in one embodiment, the server computer system 18 may retrieve the current tier points included in the patron record 96 and access the patron tier level data table 106 to determine the tier level associated with the current tier points included in the patron record 96.

In method step 506, the server computer system 18 accesses the tier level activity tracking data table 108 using the patron ID to determine if the corresponding account is frozen. If the patron account is designated as frozen, the server computer system 18 returns the method step 504 and selects another patron record.

If the patron record is not designated as frozen, the server computer system 18 proceeds to method step 508. In method step 508, the server computer system 18 accesses the patron tier level data table 106 to determine an evaluation period associated with the patron's current tier level and calculates a tier elevation range equal to the current date plus the previous number of days included in the tier evaluation period.

In method step 510, the server computer system 18 accesses the patron tracking account associated with the unique patron ID and selects patron activities records having activity dates that are within the tier evaluation range. The server computer system 18 then accesses the tier point accrual data table 102 and calculates a number of accrued tier points that were accrued during the tier evaluation range based on the tier accrual data included in the tier point accrual data table 102 and the patron wagering activity data included in the selected patron activities records. Upon determining the number of accrued tier points, the server computer system 18 determines whether to modify the tier level associated with the patron.

In method step 512, the server computer system 18 determines if the calculated number of accrued tier points is within the current tier level. If the calculated number of accrued tier points is within the current tier level, the server computer system 18 implements method step 514, and renews the current tier level and modifies the patron account data to reflect the renewed tier level.

In method step 516, the server computer system 18 determines if the calculated number of accrued tier points is less than the current tier level. If the calculated number of accrued tier points is less the current tier level, the server computer system 18 proceeds to method step 518 and downgrades the patron record by a tier level and modifies the patron account information to reflect the downgraded tier level.

In method step 520, the server computer system 18 determines if the calculated number of accrued tier points is greater than the current tier point level and upgrades the patron account to the next highest tier level.

In method step 522, the server computer system 18 accesses the bonus award data table 98 to determine a bonus award to be provide to the player based on the determined tier level of the player and the patron activities records.

For example, slot play may be configured to award tier points based on the Total Points, Base Points, or TheoWin of each slot rating. Additionally, the tier points can be multiplied by a factor. As a player plays at the casino, with each slot, table or other wager (i.e., POS) if configured, their current tier points balance is updated after the update or close of each wager rating. Their tier point balance continues to accrue until they are evaluated by the nightly process on their tier expiration date.

In the illustrated embodiment, the patron evaluation server 51 may be programmed initiate tier review operation by accessing the plurality of patron account records and selecting patron account records having gaming transaction occurring within a predefined period of time. For each selected patron account record, the patron evaluation server 51 determines a current tier level indicator 130 included in the selected patron account record 96, and accesses the tier level program file 168 to determine a target tier level having a higher ranking than a tier level associated with the current tier level indicator 130. The patron evaluation server 51 selects a tier level data record 170 associated with the target tier level and identifies a tier point amount 172 and an evaluation period 180 included in the selected tier level data record 170. The patron evaluation server 51 then accesses the patron account record 96 to retrieve gaming transactions 92 having transaction dates occurring within the identified evaluation period 180 and calculates an amount of tier points based on the retrieved gaming transactions. The patron evaluation server 51 then determines if the calculated amount of tier points 206 is equal to or greater than the tier point amount associated with the target tier level, and modifies the selected patron account record 96 to upgrade the tier level assigned to the selected patron account record 96 by replacing the current tier level indicator with a tier level indicator associated with the target tier level upon determining the calculated amount of tier points is equal to or greater than the tier point amount associated with the target tier level.

In one embodiment, the patron evaluation server 51 is programmed to select patron account records 96 that include gaming transactions 92 occurring within a previous twenty-four hour period from the time of the initiation of the tier review operation.

The patron evaluation server 51 may also be programmed to determine if the selected patron account record 96 includes a lockout designator 154. Upon identifying a lockout designator 154 in the selected patron account record 96, the patron evaluation server 51 modifies the selected patron account record 96 to set the current tier level indicator 130 to the same current tier level indicator 130, and set the expiration date 182 to the lockout expiration date 164.

In the illustrated embodiment, the patron evaluation server 51 is further programmed to initiate a tier level renewal operation by determining a current date associated with the execution of the tier level renewal operation, and select patron account records 96 having a tier expiration date 182 matching the current date. For each selected patron account record 96, the patron evaluation server 51 identifies the current tier level indicator 130 included in the selected patron account record 96, accesses the tier level program file 168 to select tier level data record 170 associated with the current tier level indicator 130 included in the selected patron account record 96, and determines a tier point amount 172, an evaluation period 180, and a renewal period 182 associated with the current tier level indicator 130 and associated tier level data record 170. The patron evaluation server computer 51 then retrieves gaming transactions 92 having transaction dates occurring within the evaluation period 180 associated with the current tier level indicator 130 and calculates an amount of tier points based on the retrieved gaming transactions 92. The patron evaluation server computer 51 compares the calculated amount of tier points with the tier point amount 172 and renews the current tier level assigned to the patron account record 96 upon determining the calculated amount of tier points is equal to or greater than the tier point amount 172 associated with the current tier level indicator 130. The patron evaluation server computer 51 modifies the selected patron account record 96 to renew the tier level assigned to the patron account record by: setting the current tier level indicator to a same current tier level indicator, setting the last evaluation date value to the current date, and setting the tier expiration date value to the sum of the current date and the renewal period.

During the tier level renewal operation, upon determining the calculated amount of tier points is less than the tier point amount associated with the current tier level indicator, the patron evaluation server 51 may be programmed to calculate a total theoretical loss value based on the wager amounts included in the retrieved gaming transactions 92, and modify the selected patron account record 96 to renew the tier level assigned to the patron account record upon determining the total theoretical loss value is equal to or greater than a predefined total theoretical loss value. For example, the patron evaluation server 51 may compare the calculated total theoretical loss value with the total theoretical loss value 176 included in the select tier level data record 170, and modify the selected patron account record to renew the tier level assigned to the patron account record 96 upon determining the calculated total theoretical loss value is equal to or greater than the total theoretical loss value 176 included in the select tier level data record 170.

In addition, during the tier level renewal operation, upon determining the calculated amount of tier points is less than the tier point amount associated with the current tier level indicator 130, the patron evaluation server computer 51 may modify the selected patron account record to downgrade the tier level assigned to the patron account record by selecting a tier level indicator from the tier level program file that is associated with a tier level having a lower ranking than a tier level associated with the current tier level indicator, determining an renewal period associated with the selected tier level indicator, setting the current tier level indicator to the selected tier level indicator, setting the last evaluation date value to the current date, and setting the tier expiration date value to the sum of the current date and the renewal period associated with the selected tier level indicator.

In one embodiment, the patron evaluation server computer programmed to calculate the amount of tier points by identifying the retrieved gaming transactions including reel machine wagers and calculating a reel machine tier point value by multiplying a total amount of wagers associated with the reel machine wagers by the reel machine multiplier value, identifying the retrieved gaming transactions including table game wagers and calculating a table game tier point value by multiplying a total amount of wagers associated with the table game wagers by the table game multiplier value, and determining a sum of the reel machine tier point value and the table game tier point value to calculate the amount of tier points.

With the SYNKROS™ system 10, while a player is playing at the casino, the player may earn Tier Points based on the accrual rates setup in FIG. 21, Tier point setup screen 120 by wager type. If their Tier Point balance (181 days historical+current days accrual) exceeds the current tier they are in, they are automatically upgraded to the next Tier and notified on the True-Time Display.

Additionally, if their Theo (181 days historical+current day's accrual) or their Actual Loss (181 days historical+current day's accrual) exceeds their current tier they are in, they are automatically upgraded to the next Tier and notified on the True-Time Display. Set ExpirationDate=current gaming day+203 days (Expiration Days); Create a record in the CLA Historical movement table.

In one embodiment, the server computer performs an automated Card Level Evaluation process nightly, including Nightly Database Process (Job 1): Purpose: Evaluate renewals and demotions. The system selects all player with CLA Expiration Date=current gaming day minus 1, including: If the player's record in the FIG. 22: CLA tracking table has them marked as Frozen, do nothing.

If the player's current Tier Point Balance, current Theo or current Actual Loss is within current tier range as setup in FIG. 20, Card Level Automation Screen 112: Then Renew player in the same card tier; Set LastSetDate=current gaming day; Set ExpirationDate=current gaming day+203 days (Expiration Days); Create a record in the CLA Historical movement table.

If the player's current Tier Point Balance, current Theo or current Actual Loss is less than their current tier range as setup in FIG. 20, Carl Level Automation Screen 112: Then Downgrade player by <maximum levels to demote>; Set LastSetDate=current gaming day; Set ExpirationDate= current gaming day+203 days (Expiration Days); Create a record in the CLA Historical movement table.

The system may include a hard coded procedure in the database to not Up-tier based on the Theo or Actual Loss at this time. Note for down-tiers, the user can set the maximum levels to demote using Card Level Automation screen 112.

The server computer system 18 may also implement a Nightly Database Process (Job 2); Purpose: Maintain 181 days historical for Tier Points, Theo and Actual Loss. The nightly process will "trim off" the 182 day from the current Tier Point per patron Meter, Theo per patron Meter and Actual Loss per patron Meter by evaluation anyone that has played 182 days ago. This will enable current play to "add" to the per patron Tier Point, Theo and Actual Loss meters for real-time evaluation of up-tiering players to the next card level.

The server computer system 18 may also allow a user to initiate a Manual Process to manually up-tier, renew or down-tier guests: Up-tiers (Ups): Calculates and populates new expiration date field based on (Current Date+Expiration Days). User has ability to alter expiration date; Renewals (Ats) or Down-tiers (Dns): Calculates and populates new expiration date field based on (Total Period) after current/old expiration date. User has ability to alter expiration date; Ability to manually alter expiration dates, by default new expiration date is (Current Date+Expiration Days) after upcoming expiration date, but can be altered by user. (Expiration Adjustment); Ability to categorize a player's card level as frozen and identify them as frozen in reports.

In one embodiment, the server computer system 18 may also generate CLA Data available for Data Marketing: Available data pulls Database Marketing can pull data from SYNKROS pertaining to CLA through views in SYNKROS DAL. Alternatively, these same views will be added to the KEI Report Writer Tool metadata layer for custom reporting.

CLA Tracking Table will be available to expose the following: PTNID (Patron Identifier); LastSetDate (Date of the last evaluation or manual adjustment); ExpirationDate (Date of next evaluation (including the grace period)); Freeze Level (1=Frozen in current level 0=Will be evaluated on Expiration Date).

CLA History Table will be available to expose the historical snapshots of the previous evaluation periods: PTNID (Patron identifier); Date of Action; PreviousTier (Tier at the time of CLA evaluation or manual intervention); MovedToTier (Tier moved to after CLA evaluation or manual intervention); PreviousTier Points (Tier Points at the time of the CLA evaluation or manual intervention); etc.

In one embodiment, the evaluation periods will be configured for all card tier the same. If the evaluation period is set 182 and grace period set to 21, thus Total Period=203 days; then CLA database routine will be evaluated all tier levels using these the 182 evaluation period. Additionally, at least 182 days of daily player ratings that include tier points, theo and actual loss since this will be used by the nightly database process #2 to "trim off" the 182's day.

Obviously, many modifications and variations of the present invention are possible in light of the above teachings. The invention may be practiced otherwise than as specifically described within the scope of the appended claims.

Exemplary embodiments of a system and method for providing gaming property services to a patron are described above in detail. The system and method are not limited to the specific embodiments described herein, but rather, components of the system and/or steps of the method may be utilized independently and separately from other components and/or steps described herein. For example, the system may also be used in combination with other wagering systems and methods, and is not limited to practice with only the system as described herein. Rather, an exemplary embodiment can be implemented and utilized in connection with many other monitoring applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor. Processors may execute one or more program applications, such as a web browser (e.g., Microsoft Internet Explorer, Mozilla Firefox, Apple Safari, Google Chrome, and Opera, etc.), to access and view content over a computer network. In particular implementations, the program applications allow a user to enter addresses of specific network resources to be retrieved, such as resources hosted by a networking system. These addresses can be Uniform Resource Locators, or URLs. In addition, once a page or other resource has been retrieved, the client applications may provide access to other pages or records when the user "clicks" on hyperlinks to other resources. By way of example, such hyperlinks may be located within the webpages and provide an automated way for the user to enter the URL of another page and to retrieve that page. A webpage or resource embedded within a webpage, which may itself include multiple embedded resources, may include data records, such as plain textual information, or more complex digitally encoded multimedia content, such as software programs or other code objects, graphics, images, audio signals, videos, and so forth. One prevalent markup language for creating webpages is the Hypertext Markup Language (HTML). Other common web browser-supported languages and technologies include the Extensible Markup Language (XML), the Extensible Hypertext Markup Language (XHTML), JavaScript, Flash, ActionScript, Cascading Style Sheet (CSS), and, frequently, Java.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

In some embodiments, a network, as describe herein, includes a network addressable system that, in various example embodiments, comprises one or more physical servers and data stores. The one or more physical servers are operably connected to a computer network via, by way of example, a set of routers and/or networking switches. In an example embodiment, the functionality hosted by the one or more physical servers may include web or HTTP servers, FTP servers, as well as, without limitation, webpages and applications implemented using Common Gateway Interface (CGI) script, PHP Hyper-text Preprocessor (PHP), Active Server Pages (ASP), Hyper Text Markup Language (HTML), Extensible Markup Language (XML), Java, JavaScript, Asynchronous JavaScript and XML (AJAX), Flash, ActionScript, and the like. Data stores may store content and data relating to, and enabling, operation of the networking system as digital data objects. A data object, in particular implementations, is an item of digital information typically stored or embodied in a data file, database or record. Content objects may take many forms, including: text (e.g., ASCII, SGML, HTML), images (e.g., jpg, tif and gif), graphics (vector-based or bitmap), audio, video (e.g., mpeg), or other multimedia, and combinations thereof. Content object data may also include executable code objects (e.g., games executable within a browser window or frame), podcasts, etc. Data stores corresponds to one or more of a variety of separate and integrated databases, such as relational databases and object-oriented databases, that maintain information as an integrated collection of logically related records or files stored on one or more physical systems.

For example, the processes described herein may be implemented using hardware components, software components, and/or any combination thereof. By way of example, while embodiments of the present disclosure have been described as operating in connection with a networking website, various embodiments of the present invention can be used in connection with any communications facility that supports web applications. Furthermore, in some embodiments the term "web service" and "website" may be used interchangeably and additionally may refer to a custom or generalized API on a device, such as a mobile device (e.g., cellular phone, smart phone, personal GPS, personal digital assistance, personal gaming device, etc.), that makes API calls directly to a server. The specification and drawings are, accordingly, to be regarded in an illustrative rather than a restrictive sense. It will, however, be evident that various modifications and changes may be made thereunto without departing from the broader spirit and scope of the invention as set forth in the claims and that the invention is intended to cover all modifications and equivalents within the scope of the following claims This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A casino management networked computer system, comprising:

a plurality of gaming machines for providing games to patrons;

a player tracking device coupled to the plurality of gaming machines, the player tracking device configured to monitor gaming session activity on each of the plurality of gaming machines;

a database server computer including a database server processor coupled to a database memory device, the database server processor programmed to:

generate and store a patron program file including a plurality of patron account records, each patron account record including a unique patron ID associated with a patron, a tier level indicator, and patron wagering data, wherein the tier level indicator is associated with a tier level assigned to the patron account record, the tier level is selected from a ranked group of tier levels, each of the ranked group of tier levels being associated with a plurality of award benefits provided by a casino property to the patron, and wherein the patron wagering data includes a plurality of gaming transaction records, each gaming transaction record including a transaction date and a wager amount of a corresponding gaming transaction;

generate and store a tier level program file including a plurality of tier level data records, each tier level data record associated with a tier level and including a tier level indicator associated with a corresponding tier level, a tier point amount, an evaluation period including a number of days, and a renewal period including a number of days; and a patron evaluation server computer including a processor programmed to:

receive data indicating gaming session activity from the player tracking device and generate gaming transaction records associated with the gaming session activity;

initiate a tier review operation including:

access the plurality of patron account records and select patron account records having gaming transactions occurring within a predefined period of time; and for each selected patron account record:

determine a current tier level indicator included in the selected patron account record;

access the tier level program file and determine a target tier level having a higher ranking than a tier level associated with the current tier level indicator and identify a tier point amount and an evaluation period associated with the target tier level;

retrieve gaming transactions having transaction dates occurring within the identified evaluation period and calculate an amount of tier points based on the retrieved gaming transactions; and modify the selected patron account record to upgrade the tier level assigned to the patron account record by replacing the current tier level indicator with a tier level indicator associated with the target tier level upon determining the calculated amount of tier points is equal to or greater than the tier point amount associated with the target tier level; and receive a user request to modify a patron account record via a user computing device and responsively access the patron program file and retrieve a patron account record;

display a tier adjustment webpage to a user via a user computing device, the tier adjustment webpage including:

a current card type display field displaying a current tier level indicator associated with the retrieved patron account record;

a tier adjustment selector including a drop-down menu including a plurality of tier level indicators selectable by the user; and an expiration date input field;

receive a user selection of a tier level indicator being displayed in the tier adjustment selector drop-down menu;

receive a user input of a number of days via the expiration date input field; and update the retrieve a patron account record by:

setting the current tier level indicator to the user selected tier level indicator; and setting the tier expiration date value to the sum of the current date and the number of days input via the expiration date input field.

2. The networked computer system of claim 1, wherein the patron evaluation server is programmed to select patron account records including gaming transaction occurring within a previous twenty-four hour period from the initiation of the tier review operation.

3. The networked computer system of claim 1, wherein the patron evaluation server is programmed to determine if the selected patron account record includes a lockout designator and responsively modify the selected patron account record to set the current tier level indicator to a same current tier level indicator.

4. The networked computer system of claim 1, wherein each patron account record includes a last evaluation date and a tier expiration date, the patron evaluation server is further programmed to initiate a tier level renewal operation including:

determine a current date associated with the tier level renewal operation;

select patron account records having a tier expiration date matching the current date; and for each selected patron account record:

identify the current tier level indicator included in the selected patron account record;

access the tier level program file and determine a tier point amount, an evaluation period, and a renewal period associated with the current tier level indicator;

retrieve gaming transactions having transaction dates occurring within the evaluation period associated with the current tier level indicator and calculate an amount of tier points based on the retrieved gaming transactions; and upon determining the calculated amount of tier points is equal to or greater than the tier point amount associated with the current tier level indicator, modify the selected patron account record to renew the tier level assigned to the patron account record by:

setting the current tier level indicator to a same current tier level indicator;

setting the last evaluation date value to the current date; and setting the tier expiration date value to the sum of the current date and the renewal period.

5. The networked computer system of claim 4, wherein the patron evaluation server is programmed to:

upon determining the calculated amount of tier points is less than the tier point amount associated with the current tier level indicator, calculate a total theoretical loss value based on the wager amounts included in the retrieved gaming transactions; and modify the selected patron account record to renew the tier level assigned to the patron account record upon determining the total theoretical loss value is equal to or greater than a predefined total theoretical loss value.

6. The networked computer system of claim 4, wherein the patron evaluation server is programmed to:

upon determining the calculated amount of tier points is less than the tier point amount associated with the current tier level indicator, modify the selected patron account record to downgrade the tier level assigned to the patron account record by:

selecting a tier level indicator from the tier level program file that is associated with a tier level having a lower ranking than a tier level associated with the current tier level indicator;

determining an renewal period associated with the selected tier level indicator;

setting the current tier level indicator to the selected tier level indicator;

setting the last evaluation date value to the current date; and setting the tier expiration date value to the sum of the current date and the renewal period associated with the selected tier level indicator.

7. The networked computer system of claim 1, wherein the tier level program file includes a first tier level including a first evaluation period and a second tier level including a second evaluation period that is different than the first evaluation period.

8. The networked computer system of claim 1, wherein the patron evaluation server computer programmed to:

access the tier level program file and display a tier level setup webpage to a user via a user computing device, the tier level setup webpage displaying a tier level matrix including:

a plurality of rows and a plurality of columns intersecting the plurality of rows to define a plurality of logic cells, each row corresponding to a tier level data record, each tier level data record including a tier point logic cell adapted to receive a user defined value associated with an amount of tier points, a theoretical loss logic cell adapted to receive a user defined value associated with a theoretical loss amount, and an actual loss logic cell adapted to receive a user defined value associated with an actual loss amount.

9. The networked computer system of claim 1, wherein the patron evaluation server computer programmed to:

initiate a game on at least one gaming machine; and during the game, display a progress bar on the at least one gaming machine indicating the amount of tier points required to reach the target tier level.

10. The networked computer system of claim 1, wherein the database server computer is programmed to:

generate each gaming transaction record including a wagering transaction type including at least one of a reel machine wager and a table game wager; and generate and store a tier point program file including a plurality of tier point accrual records, each tier point accrual record including a wagering transaction type and a corresponding multiplier value, the plurality of tier point accrual records including a reel machine accrual record including a reel machine multiplier value associated with the reel machine wager and a table game accrual record including a table game multiplier value associated with the table game wager;

the patron evaluation server computer programmed to:

calculate the amount of tier points by:

identifying the retrieved gaming transactions including reel machine wagers and calculating a reel machine tier point value by multiplying a total amount of wagers associated with the reel machine wagers by the reel machine multiplier value;

identifying the retrieved gaming transactions including table game wagers and calculating a table game tier point value by multiplying a total amount of wagers associated with the table game wagers by the table game multiplier value; and determining a sum of the reel machine tier point value and the table game tier point value.

11. The networked computer system of claim 10, wherein the patron evaluation server computer is programmed to:

display a tier point setup webpage to a user via a user computing device, the tier point setup webpage including:

a reel machine tier point input field including a plurality of tier point calculation selectors and a reel machine multiplier value input field, each of the plurality of tier point calculation selectors being associated with a different tier point calculation method;

receive a user selection of a tier point calculation selector;

receive a user defined reel machine multiplier value via the reel machine multiplier value input field; and update the reel machine accrual record to set a reel machine tier point calculation method to the user selected tier point calculation method and set the reel machine multiplier value to the user defined reel machine multiplier value.

12. A non-transitory computer-readable storage medium storing computer-executable instructions, which when executed by a processor, cause the processor to perform a method comprising:

receiving data indicating gaming session activity from a player tracking device coupled to a plurality of gaming machines and generate gaming transaction records associated with the gaming session activity;

generating a patron program file including a plurality of patron account records, each patron account record including a unique patron ID associated with a patron, a tier level indicator, and patron wagering data, wherein the tier level indicator is associated with a tier level assigned to the patron account record, the tier level is selected from a ranked group of tier levels, each of the ranked group of tier levels being associated with a plurality of award benefits provided by a casino property to the patron, and wherein the patron wagering data includes a plurality of gaming transaction records, each gaming transaction record including a transaction date and a wager amount of a corresponding gaming transaction;

generating a tier level program file including a plurality of tier level data records, each tier level data record associated with a tier level and including a tier level indicator associated with a corresponding tier level, a tier point amount, an evaluation period including a number of days, and a renewal period including a number of days;

initiating a tier review operation including:

accessing the plurality of patron account records and select patron account records having gaming transactions occurring within a predefined period of time; and for each selected patron account record:

determining a current tier level indicator included in the selected patron account record;

accessing the tier level program file and determine a target tier level having a higher ranking than a tier level associated with the current tier level indicator and identifying a tier point amount and an evaluation period associated with the target tier level;

retrieving gaming transactions having transaction dates occurring within the identified evaluation period and calculating an amount of tier points based on the retrieved gaming transactions; and modifying the selected patron account record to upgrade the tier level assigned to the patron account record by replacing the current tier level indicator with a tier level indicator associated with the target tier level upon determining the calculated amount of tier points is equal to or greater than the tier point amount associated with the target tier level; and receiving a user request to modify a patron account record via a user computing device and responsively accessing the patron program file and retrieve a patron account record;

displaying a tier adjustment webpage to a user via a user computing device, the tier adjustment webpage including:

a current card type display field displaying a current tier level indicator associated with the retrieved patron account record;

a tier adjustment selector including a drop-down menu including a plurality of tier level indicators selectable by the user; and an expiration date input field;

receiving a user selection of a tier level indicator being displayed in the tier adjustment selector drop-down menu;

receiving a user input of a number of days via the expiration date input field; and updating the retrieve a patron account record by:

setting the current tier level indicator to the user selected tier level indicator; and setting the tier expiration date value to the sum of the current date and the number of days input via the expiration date input field.

13. The non-transitory computer-readable storage medium of claim 12, wherein the computer-executable instructions cause the processor to determine if the selected patron account record includes a lockout designator and responsively modify the selected patron account record to set the current tier level indicator to a same current tier level indicator.

14. The non-transitory computer-readable storage medium of claim 12, wherein the computer-executable instructions cause the processor to:

generate each patron account record including a last evaluation date and a tier expiration date; and initiate a tier level renewal operation including:

determining a current date associated with the tier level renewal operation;

selecting patron account records having a tier expiration date matching the current date; and for each selected patron account record:

identifying the current tier level indicator included in the selected patron account record;

accessing the tier level program file and determine a tier point amount, an evaluation period, and a renewal period associated with the current tier level indicator;

retrieving gaming transactions having transaction dates occurring within the evaluation period associated with the current tier level indicator and calculating an amount of tier points based on the retrieved gaming transactions; and upon determining the calculated amount of tier points is equal to or greater than the tier point amount associated with the current tier level indicator, modifying the selected patron account record to renew the tier level assigned to the patron account record by:

setting the current tier level indicator to a same current tier level indicator;

setting the last evaluation date value to the current date; and setting the tier expiration date value to the sum of the current date and the renewal period.

15. The non-transitory computer-readable storage medium of claim 12, wherein the computer-executable instructions cause the processor to:

upon determining the calculated amount of tier points is less than the tier point amount associated with the current tier level indicator, modify the selected patron account record to downgrade the tier level assigned to the patron account record by:

selecting a tier level indicator from the tier level program file that is associated with a tier level having a lower ranking than a tier level associated with the current tier level indicator;

determining an renewal period associated with the selected tier level indicator;

setting the current tier level indicator to the selected tier level indicator;

setting the last evaluation date value to the current date; and setting the tier expiration date value to the sum of the current date and the renewal period associated with the selected tier level indicator.

16. The non-transitory computer-readable storage medium of claim 12, wherein the computer-executable instructions cause the processor to:

access the tier level program file and display a tier level setup webpage to a user via a user computing device, the tier level setup webpage displaying a tier level matrix including:

a plurality of rows and a plurality of columns intersecting the plurality of rows to define a plurality of logic cells, each row corresponding to a tier level data record, each tier level data record including a tier point logic cell adapted to receive a user defined value associated with an amount of tier points, a theoretical loss logic cell adapted to receive a user defined value associated with a theoretical loss amount, and an actual loss logic cell adapted to receive a user defined value associated with an actual loss amount.

17. The non-transitory computer-readable storage medium of claim 12, wherein the computer-executable instructions cause the processor to:

initiate a game on at least one gaming machine; and during the game, display a progress bar on the at least one gaming machine indicating the amount of tier points required to reach the target tier level.

18. The non-transitory computer-readable storage medium of claim 12, wherein the computer-executable instructions cause the processor to:

generate each gaming transaction record including a wagering transaction type including at least one of a reel machine wager and a table game wager;

generate a tier point program file including a plurality of tier point accrual records, each tier point accrual record including a wagering transaction type and a corresponding multiplier value, the plurality of tier point accrual records including a reel machine accrual record including a reel machine multiplier value associated with the reel machine wager and a table game accrual record including a table game multiplier value associated with the table game wager; and calculate the amount of tier points by:

identifying the retrieved gaming transactions including reel machine wagers and calculating a reel machine tier point value by multiplying a total amount of wagers associated with the reel machine wagers by the reel machine multiplier value;

identifying the retrieved gaming transactions including table game wagers and calculating a table game tier point value by multiplying a total amount of wagers associated with the table game wagers by the table game multiplier value; and determining a sum of the reel machine tier point value and the table game tier point value.

19. The non-transitory computer-readable storage medium of claim 18, wherein the computer-executable instructions cause the processor to:

display a tier point setup webpage to a user via a user computing device, the tier point setup webpage including:

a reel machine tier point input field including a plurality of tier point calculation selectors and a reel machine multiplier value input field, each of the plurality of tier point calculation selectors being associated with a different tier point calculation method;

receive a user selection of a tier point calculation selector;

receive a user defined reel machine multiplier value via the reel machine multiplier value input field; and update the reel machine accrual record to set a reel machine tier point calculation method to the user selected tier point calculation method and set the reel machine multiplier value to the user defined reel machine multiplier value.

20. A method comprising:

generating, by a database computer system, a patron program file including a plurality of patron account records, each patron account record including a unique patron ID associated with a patron, a tier level indicator, and patron wagering data, wherein the tier level indicator is associated with a tier level assigned to the patron account record, the tier level is selected from a ranked group of tier levels, each of the ranked group of tier levels being associated with a plurality of award benefits provided by a casino property to the patron, and wherein the patron wagering data includes a plurality of gaming transaction records, each gaming transaction record including a transaction date and a wager amount of a corresponding gaming transaction;

generating, by the database computer system, a tier level program file including a plurality of tier level data records, each tier level data record associated with a tier level and including a tier level indicator associated with a corresponding tier level, a tier point amount, an evaluation period including a number of days, and a renewal period including a number of days;

receiving, by a patron evaluation computer system, data indicating gaming session activity from a player tracking device coupled to a plurality of gaming machines and generate gaming transaction records associated with the gaming session activity;

initiating, by the patron evaluation computer system, a tier review operation including:

accessing the plurality of patron account records and selecting patron account records having gaming transactions occurring within a predefined period of time; and for each selected patron account record:

determining a current tier level indicator included in the selected patron account record;

accessing the tier level program file, determining a target tier level having a higher ranking than a tier level associated with the current tier level indicator, and identifying a tier point amount and an evaluation period associated with the target tier level;

retrieving gaming transactions having transaction dates occurring within the identified evaluation period and calculating an amount of tier points based on the retrieved gaming transactions; and modifying the selected patron account record to upgrade the tier level assigned to the patron account record by replacing the current tier level indicator with a tier level indicator associated with the target tier level upon determining the calculated amount of tier points is equal to or greater than the tier point amount associated with the target tier level; and receiving a user request to modify a patron account record via a user computing device and responsively accessing the patron program file and retrieve a patron account record;

displaying a tier adjustment webpage to a user via a user computing device, the tier adjustment webpage including:

a current card type display field displaying a current tier level indicator associated with the retrieved patron account record;

a tier adjustment selector including a drop-down menu including a plurality of tier level indicators selectable by the user; and an expiration date input field;

receiving a user selection of a tier level indicator being displayed in the tier adjustment selector drop-down menu;

receiving a user input of a number of days via the expiration date input field; and updating the retrieve a patron account record by:

setting the current tier level indicator to the user selected tier level indicator; and setting the tier expiration date value to the sum of the current date and the number of days input via the expiration date input field.

* * * * *